US011124380B2

(12) United States Patent
Mizutani

(10) Patent No.: US 11,124,380 B2
(45) Date of Patent: Sep. 21, 2021

(54) SHEET BINDING APPARATUS AND IMAGE FORMING SYSTEM

(71) Applicant: TOSHIBA TEC KABUSHIKI KAISHA, Tokyo (JP)

(72) Inventor: Kikuo Mizutani, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/515,085

(22) Filed: Jul. 18, 2019

(65) Prior Publication Data

US 2020/0172366 A1 Jun. 4, 2020

(30) Foreign Application Priority Data

Dec. 4, 2018 (JP) ..... JP2018-227579

(51) Int. Cl.
*B65H 37/04* (2006.01)
*B65H 29/12* (2006.01)
*B65B 27/08* (2006.01)

(52) U.S. Cl.
CPC ..... *B65H 37/04* (2013.01); *B65B 27/08* (2013.01); *B65H 29/12* (2013.01); *B65H 2301/43821* (2013.01); *B65H 2301/5161* (2013.01)

(58) Field of Classification Search
CPC ..... B65H 37/04; B65H 29/12; B65H 2301/5161; B65H 2301/43821; B65H 2801/27; B42C 1/00; Y10T 156/1062
See application file for complete search history.

(56) References Cited

U.S. PATENT DOCUMENTS

| | | | |
|---|---|---|---|
| 10,031,465 | B2 | 7/2018 | Sunaoshi et al. |
| 10,202,252 | B2 | 2/2019 | Mizutani |
| 10,252,877 | B2 | 4/2019 | Sunaoshi et al. |
| 2019/0135571 | A1 | 5/2019 | Mizutani |
| 2019/0143732 | A1 | 5/2019 | Sunaoshi et al. |
| 2019/0143733 | A1 | 5/2019 | Mizutani |
| 2020/0262232 | A1 | 8/2020 | Mizutani |
| 2020/0264551 | A1 | 8/2020 | Mizutani |

FOREIGN PATENT DOCUMENTS

| | | |
|---|---|---|
| EP | 0547788 | 6/1993 |
| JP | 2016-148018 | 8/2016 |

OTHER PUBLICATIONS

Extended European Search Report for European Patent Application No. 19193060.1 dated Mar. 2, 2020.

*Primary Examiner* — Mark A Osele
*Assistant Examiner* — Christopher C Caillouet
(74) *Attorney, Agent, or Firm* — Amin, Turocy & Watson, LLP

(57) ABSTRACT

A sheet binding apparatus according to an embodiment includes a tape holding section and a guide section. The tape holding section holds a tape in at least two parts. The guide section guides a sheet bundle to between the two parts of the tape. The tape holding section bends and holds the tape to be convex to a conveying direction downstream side of the sheet bundle.

13 Claims, 29 Drawing Sheets

SHEET BINDING APPARATUS AND IMAGE FORMING SYSTEM

CROSS-REFERENCE TO RELATED APPLICATION

This application is based upon and claims the benefit of priority from Japanese Patent Application No. 2018-227579, filed Dec. 4, 2018, the entire contents of which are incorporated herein by reference.

FIELD

Embodiments described herein relate generally to a sheet binding apparatus and an image forming system and methods associated therewith.

BACKGROUND

There has been known a sheet binding apparatus that binds an edge portion of a sheet bundle with an adhesive tape. The sheet binding apparatus includes a bundle forming section and a tape attaching section. The bundle forming section stacks a plurality of sheets to form a sheet bundle. The bundle forming section forms a side portion of the sheet bundle in a step shape in order to secure a surface area during tape attachment. The tape attaching section attaches the adhesive tape to an edge portion of the sheet bundle to bind the sheet bundle. The tape attaching section includes a tape holding section that holds the adhesive tape. The sheet bundle shifted in the step shape is inserted toward the adhesive tape held by the tape holding section, whereby the adhesive tape is peeled from the tape holding section and attached to the edge portion of the sheet bundle.

However, if the adhesive tape is peeled from the tape holding section, the leading end (a projecting end) of the edge portion of the sheet bundle shifted in the step shape bumps into the adhesive tape. Therefore, a sheet is likely to yield to a force for peeling the adhesive tape from the tape holding section to be turned up.

DESCRIPTION OF THE DRAWINGS

FIG. 3A being a diagram illustrating the operation performed if the shift amount between the sheets is relatively small and FIG. 3B being a diagram illustrating the operation performed if the shift amount between the sheets is relatively large;

DETAILED DESCRIPTION

Figure 1:
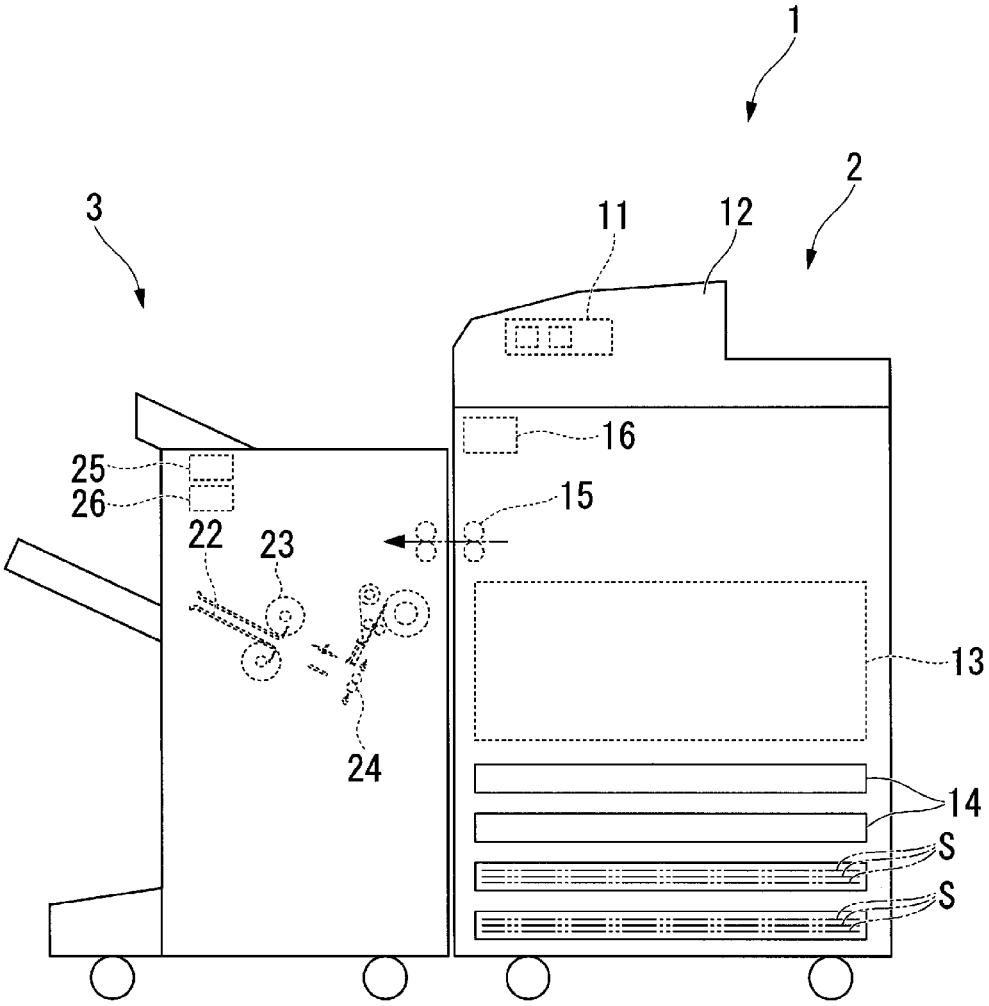
FIG. 1 is a front view illustrating an image forming system according to a first embodiment.

An object of embodiments is to provide a sheet binding apparatus and an image forming system that can suppress turn-up of a sheet.

A sheet binding apparatus according to an embodiment includes a tape holding section and a guide section. The tape holding section holds a tape in at least two parts. The guide section guides a sheet bundle to between the two parts of the tape. The tape holding section bends and holds the tape to be convex to a conveying direction downstream side of the sheet bundle.

Sheet binding apparatuses according to embodiments are explained below with reference to the drawings. In the following explanation, components having the same or similar functions are denoted by the same reference numerals and signs. Redundant explanation of the components is sometimes omitted. In this application, various sheet-like media including paper is referred to as “sheet”.

First, one embodiment is explained with reference to FIG. 1 to 10.

FIG. 1 is a front view illustrating an image forming system 1 according to this embodiment. The image forming system 1 according to this embodiment includes a sheet binding apparatus 3 that binds an edge portion 5*a* of a sheet bundle 5 with a tape T (see FIG. 9). For example, the sheet binding apparatus 3 is a post-processing apparatus that is disposed beside an image forming apparatus 2 and performs post-processing on a sheet S conveyed from the image forming apparatus 2.

The image forming apparatus 2 is briefly explained first.

A illustrated in FIG. 1, the image forming apparatus 2 includes a control panel 11, a scanner section 12, a printer section 13, a paper feeding section 14, a paper discharging section 15, and a control section 16.

The control panel 11 includes various keys and receives operation by a user.

The scanner section 12 reads image information of a copying target object.

The printer section 13 forms an image on the sheet S based on image information received from the scanner section 12 or an external apparatus.

The paper feeding section 14 feeds the sheet S to the printer section 13.

The paper discharging section 15 conveys the sheet S discharged from the printer section 13 to the sheet binding apparatus 3.

The control section 16 controls various operations of the control panel 11, the scanner section 12, the printer section 13, the paper feeding section 14, and the paper discharging section 15.

The sheet binding apparatus 3 is explained.

The sheet binding apparatus 3 includes a bundle forming section 22, a sheet shifting section 23, a tape processing section 24, a storing section 25, and a binding control section 26.

The bundle forming section 22 is explained.

Figure 2:
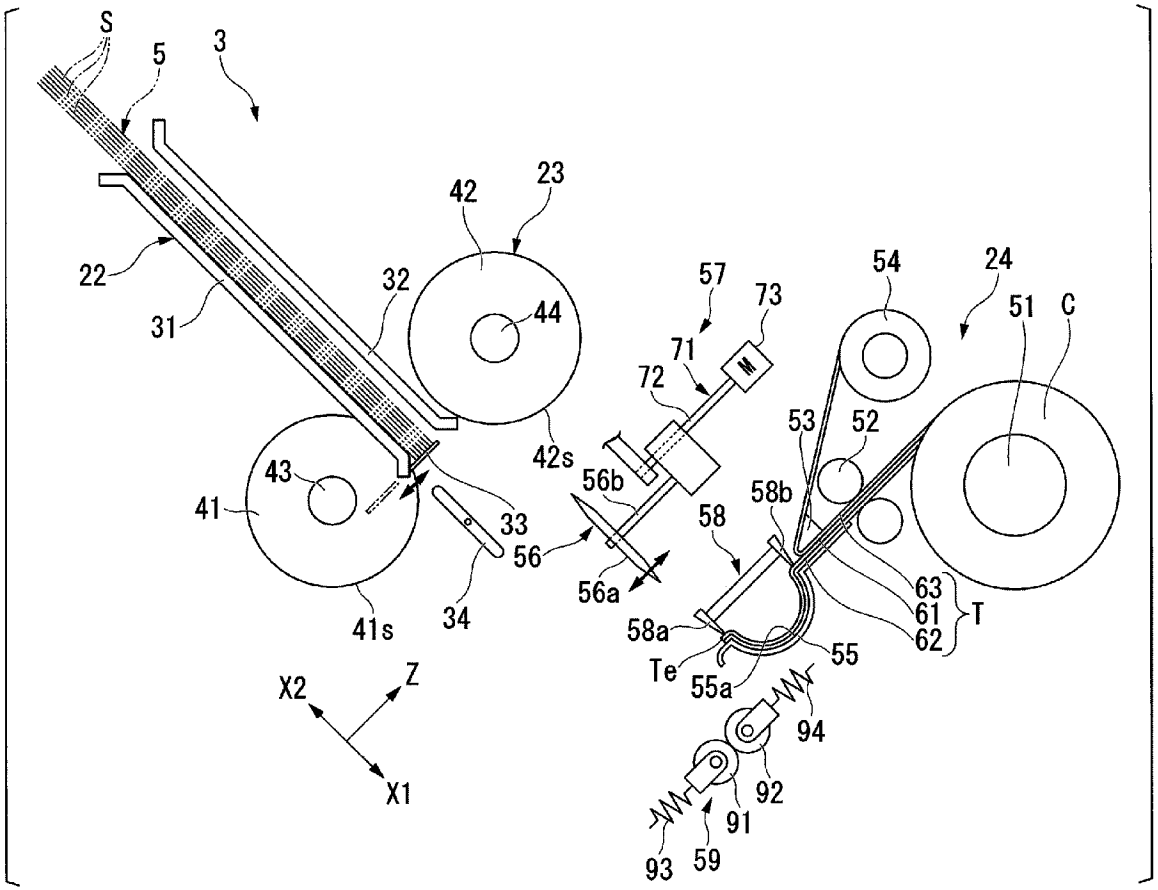
FIG. 2 is a front view illustrating an internal configuration of a sheet binding apparatus according to the first embodiment.

FIG. 2 is a front view illustrating an internal configuration of the sheet binding apparatus 3.

As illustrated in FIG. 2, the bundle forming section 22 stacks a plurality of sheets S to form the sheet bundle 5. The bundle forming section 22 includes a main guide 31, a sub-guide 32, a stopper 33, and a switching member 34.

The main guide 31 guides the sheet S along a sheet conveying direction X1. The plurality of sheets S are stacked in order on the main guide 31 to form the sheet bundle 5. A downstream side end portion of the main guide 31 in the sheet conveying direction X1 is formed in a comb teeth shape to avoid a first roller 41 of the sheet shifting section 23.

The sub-guide 32 faces the main guide 31 in a thickness direction Z of the sheet bundle 5 (hereinafter referred to as sheet bundle thickness direction Z). A space in which the sheets S are stacked is provided between the main guide 31 and the sub-guide 32. A downstream side end portion of the sub-guide 32 in the sheet conveying direction X1 is formed in a comb teeth shape to avoid a second roller 42 of the sheet shifting section 23.

The stopper 33 is provided at the downstream side end portion of the main guide 31 in the sheet conveying direction X1. The stopper 33 is movable between a restricting position (indicated by a solid line in FIG. 2) and a releasing position (indicated by an alternate long and two short dashes line in FIG. 2) by a not-illustrated moving mechanism. In the restricting position, the stopper 33 projects further upward than the upper surface of the main guide 31. In the restricting position, the stopper 33 stops the sheet S if an end portion of the sheet S comes into contact with the stopper 33. Therefore, the sheets S accumulate on the main guide 31 and the sheet bundle 5 is formed. On the other hand, in the releasing position, the stopper 33 retracts further downward than the upper surface of the main guide 31. In the releasing position, the stopper 33 allows the sheet bundle 5 on the main guide 31 to pass toward the switching member 34.

The switching member 34 switches a conveying path of the sheet bundle 5. In the following explanation, a direction in which the sheet bundle 5 is conveyed toward the tape processing section 24 (specifically, a tape attaching section 59 explained below) is referred to as "first conveying direction (inserting direction)". On the other hand, a direction in which the sheet bundle 5 is conveyed toward a position different from the tape attaching section 59 (e.g., below the bundle forming section 22) is referred to as "second conveying direction". The switching member 34 switches the conveying path of the sheet bundle 5 between the first conveying direction and the second conveying direction.

The sheet shifting section 23 is explained.

The sheet shifting section 23 slightly shifts the plurality of sheets S in order little by little in the sheet conveying direction X1 to form a state in which the plurality of sheets S forming the sheet bundle 5 are shifted from one another at the edge portion 5*a* of the sheet bundle 5. For example, the sheet shifting section 23 forms a state in which the plurality of sheets S are shifted in a step shape at the edge portion 5*a* of the sheet bundle 5.

The sheet shifting section 23 includes a first roller 41 and a second roller 42. The first roller 41 is attached to a first shaft 43. The first roller 41 is a driving roller driven by a not-illustrated motor via the first shaft 43. The first roller 41 is fixed in a home position. The material of the first roller 41 is not particularly limited. For example, the first roller 41 is formed of ethylene propylene diene rubber (EPDM).

The second roller 42 is attached to a second shaft 44. For example, the second roller 42 is a driven roller that rotates according to the rotation of the first roller 41. The second roller 42 is movable in a direction approaching the first roller 41 and a direction away from the first roller 41 by a not-illustrated moving mechanism. The second roller 42 is moved toward the first roller 41 to come into contact with the sheet bundle 5 from the opposite side of the first roller 41.

An outer circumferential surface 42*s* of the second roller 42 is softer than an outer circumferential surface 41*s* of the first roller 41 and is deformable along the surface of the sheet bundle 5. For example, the second roller 42 is formed of sponge, rubber including a hollow on the inside, or the like. If the second roller 42 is brought close to the first roller 41, the outer circumferential surface 42*s* of the second roller 42 is deformed in an arcuate shape conforming to the outer circumferential surface 41*s* of the first roller 41 together with the sheet bundle 5.

Figure 3A:
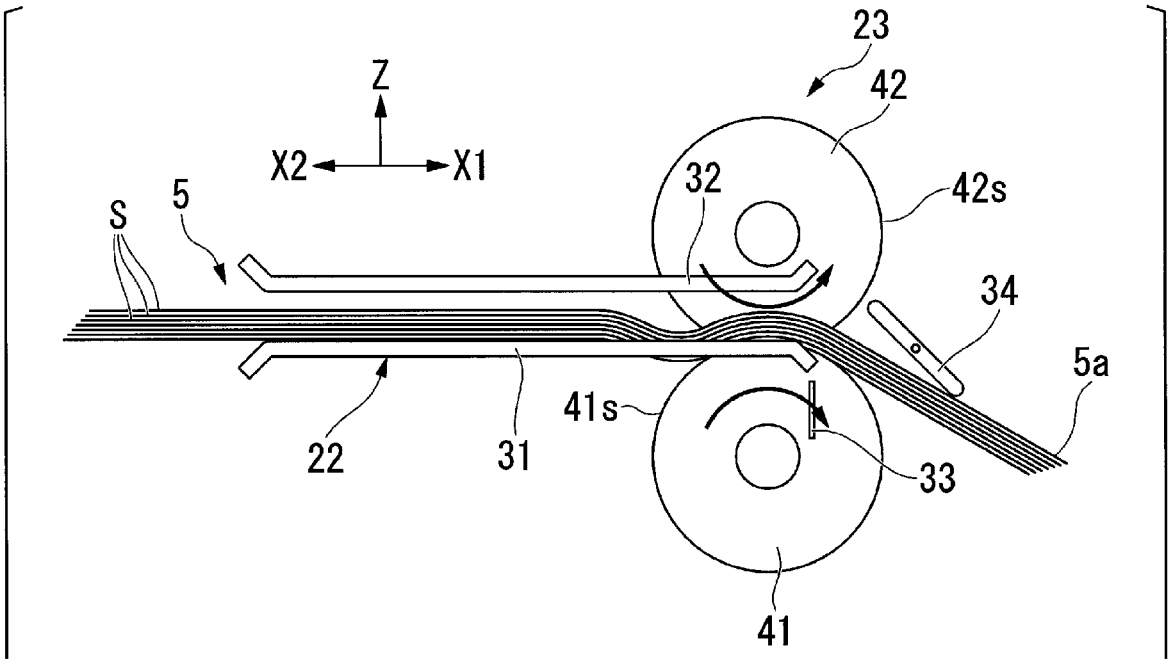
FIGS. 3A and 3B are side views illustrating an operation for changing a shift amount between sheets.
Figure 3B:
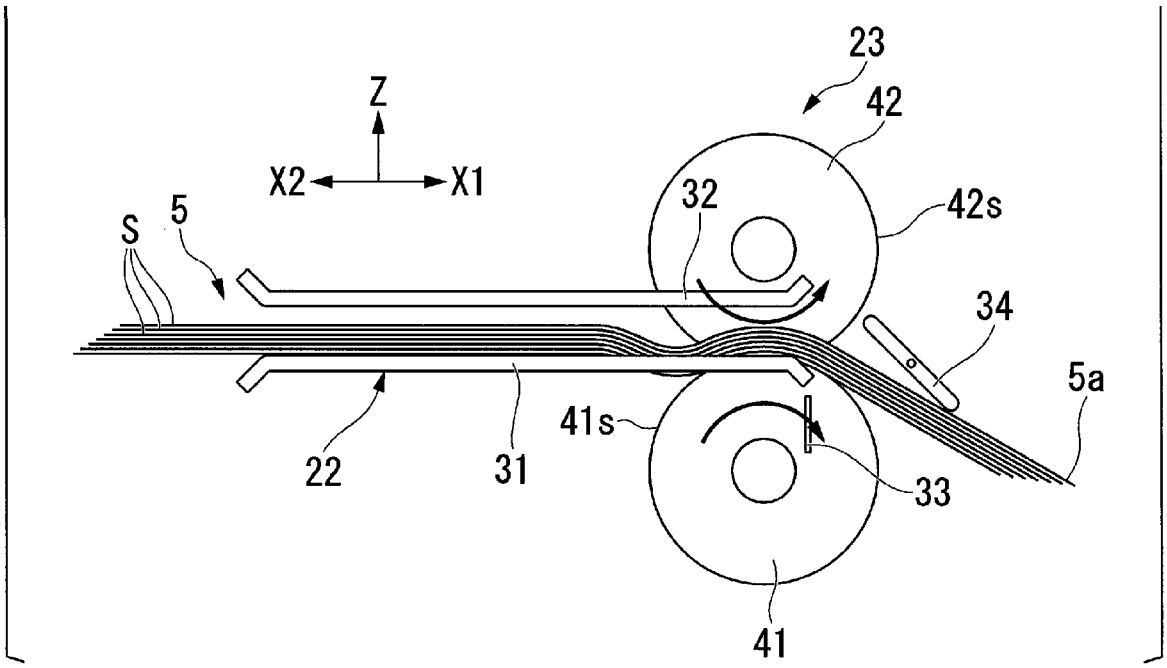

FIGS. 3A and 3B are side views illustrating an operation for changing a shift amount d between the sheets S with the sheet shifting section 23. FIG. 3A illustrates the operation performed if the shift amount d between the sheets S is relatively small and FIG. 3B illustrates the operation performed if the shift amount d between the sheets S is relatively large.

As illustrated in FIG. 3, the sheet shifting section 23 can reduce the shift amount d between the sheets S by setting a rotation angle of the first roller 41 smaller than a preset reference amount. On the other hand, the sheet shifting section 23 can increase the shift amount d between the sheets S by setting the rotation angle of the first roller 41 larger than the reference amount.

The tape processing section 24 is explained.

As illustrated in FIG. 2, the tape processing section 24 includes an unwinding section 51, a tape conveying section 52, a separating member 53, a winding section 54, a guide stand 55, a cutter 56, a cutting-length changing section 57, a tape holding section 58, and a tape attaching section 59.

The unwinding section 51 is an example of a "tape supplying section". For example, the unwinding section 51 holds a web roll obtained by winding a belt-like tape T (hereinafter simply referred to as "tape T"). The unwinding section 51 supplies the tape T along the length direction of the tape T. The tape T includes an adhesive layer 61, a protective film (a first film) 62, and a peeling film (a second film) 63 in a state in which the tape T is held by the unwinding section 51. The protective film 62 covers the adhesive layer 61 from one side. The protective film 62 is integral with the adhesive layer 61 during use of the tape T. On the other hand, the peeling film 63 covers the adhesive layer 61 from the opposite side of the protective film 62. The peeling film 63 is peeled from the adhesive layer 61 before the use of the tape T. The peeling film 63 is wound by the separating member 53 and the winding section 54.

The tape conveying section 52 conveys, along the length direction of the tape T, the tape T supplied from the unwinding section 51. For example, the length direction of the tape T is a direction substantially parallel to the sheet bundle thickness direction Z. For example, the tape conveying section 52 is a conveying roller pair that conveys the tape T.

The guide stand 55 is an example of a tape conveyance guide that forms a conveying path of the tape T. The guide stand 55 guides the tape T from which the peeling film 63 is separated. The guide stand 55 supports the tape T during holding and during cutting of the tape T. The guide stand 55 includes a recessed section 55*a* for holding the tape T to be bent in a curve shape. A conveying direction of the tape T (the length direction of the tape T) crosses the vertical plane. The recessed section 55*a* has a curve shape convex downward. The recessed section 55*a* has an arcuate shape convex toward the sheet conveying direction X1.

The cutter 56 cuts the belt-like tape T supplied from the unwinding section 51 to form a sheet-like tape T. For example, the cutter 56 is a rotor cutter. The cutter 56 includes a cutting edge 56*a* and a supporting shaft 56*b*. The supporting shaft 56*b* is rotated by a not-illustrated motor, whereby the cutting edge 56*a* is driven to rotate. The configuration of the cutter 56 is not limited to the example explained above. The configuration of the cutter 56 may be any configuration if the cutter 56 can cut the tape T supplied from the unwinding section 51. The cutter 56 is movable in a direction approaching the tape T and a direction away from the tape T by a not-illustrated moving mechanism.

The cutting-length changing section 57 changes length L (see FIG. 7) of the tape T cut by the cutter 56. "The length L of the tape" in this application is the length (the width) of the tape T in the sheet bundle thickness direction Z. In other words, "the length L of the tape" is length in a direction in which the edge portion 5*a* of the sheet bundle 5 is wrapped from a first surface 7*a* to a second surface 7*b* of the sheet bundle 5 explained below.

The cutting-length changing section 57 includes a moving mechanism 71 that changes a relative position of the cutter 56 with respect to a leading end Te of the tape T supplied from the unwinding section 51. For example, the moving mechanism 71 moves the cutter 56 to change the relative position of the cutter 56 with respect to the leading end Te of the tape T. For example, the moving mechanism 71 moves the cutter 56 along the sheet bundle thickness direction Z. "The relative position of the cutter 56 with respect to the leading end Te of the tape T" is, for example, a relative position of the cutter 56 with respect to the leading end Te of the tape T at the time when the tape T is cut by the cutter 56.

In this embodiment, the moving mechanism 71 includes a supporting member 72 supporting the cutter 56 and a driving source 73 that moves the cutter 56 via the supporting member 72. For example, the supporting member 72 is a ball screw coupled to the cutter 56. The driving source 73 is a motor that drives the ball screw to move the cutter 56. The configurations of the supporting member 72 and the driving source 73 are not limited to the examples explained above. For example, the supporting member 72 may be a cam or the like that is in contact with the cutter 56. The driving source 73 may be a solenoid or the like that moves the cutter 56 via the supporting member 72. In this case, the supporting member 72 is a coupling member that couples the cutter 56 and the solenoid.

The configuration of the moving mechanism 71 is not limited to the example explained above. For example, the moving mechanism 71 may change a letting-out length of the tape T with respect to the cutter 56 fixed in a home position to change the relative position of the cutter 56 with respect to the leading end Te of the tape T. A configuration in this case is explained below.

In this embodiment, the cutting-length changing section 57 is controlled by the binding control section 26 explained below. For example, the binding control section 26 controls the driving source 73 of the cutting-length changing section 57 to move the cutter 56 and changes the length L of the tape T cut by the cutter 56. For example, the cutting-length changing section 57 is controlled by the binding control section 26, whereby the operation of the cutting-length changing section 57 explained below is performed.

In this embodiment, the cutting-length changing section 57 changes, based on the shift amount d between the sheets S changed by the binding control section 26, the length of the tape T cut by the cutter 56. For example, if the shift amount d between the sheets S is increased by the binding control section 26, the cutting-length changing section 57 increases the length L of the tape T cut by the cutter 56. On the other hand, if the shift amount d between the sheets S is reduced by the binding control section 26, the cutting-length changing section 57 reduces the length L of the tape T cut by the cutter 56.

The tape holding section 58 supports the tape T in a state in which the posture of the tape T is retained in a curve shape (an arcuate shape). The tape holding section 58 is movable along the length direction of the tape T by a not-illustrated moving mechanism. The tape holding section 58 is movable in a direction approaching the tape T and a direction away from the tape T by a not-illustrated moving mechanism.

The tape holding section 58 includes a first tape supporting section 58*a* and a second tape supporting section 58*b* that support the tape T. Each of the first tape supporting section 58*a* and the second tape supporting section 58*b* extends along an inserting direction of the sheet bundle 5 (the sheet conveying direction X1). The first tape supporting section 58*a* and the second tape supporting section 58*b* are disposed to be spaced apart from each other in the conveying direction of the tape T. Each of the first tape supporting section 58*a* and the second tape supporting section 58*b* has a sharp shape tapered toward an adhesive surface of the tape T (an adhesive surface of the adhesive layer 61).

The tape attaching section (a tape wrapping section) 59 includes a first roller 91, a second roller 92, a first spring 93, and a second spring 94. The first roller 91 and the second roller 92 are disposed side by side in the conveying direction of the tape T. The first spring 93 urges the first roller 91 toward the second roller 92. The second spring 94 urges the second roller 92 toward the first roller 91. The first roller 91 and the first spring 93 form an example of a "first urging section" in cooperation with each other. The second roller 92 and the second spring 94 form an example of a "second urging section" in cooperation with each other. If the tape T is attached, the edge portion 5*a* of the sheet bundle 5 is inserted between the first roller 91 and the second roller 92 together with the tape T. Consequently, the tape T is bent by the tape attaching section 59 to wrap the edge portion 5*a* of the sheet bundle 5. The tape T is attached to the edge portion 5*a* of the sheet bundle 5.

The binding control section 26 is formed by a control circuit or the like including a CPU, a ROM, and a RAM provided in the sheet binding apparatus 3. A processor such as a CPU executes a computer program, whereby the binding control section 26 controls the operation of the sheet binding apparatus 3. For example, the binding control section 26 controls various operations of the bundle forming section 22, the sheet shifting section 23, and the tape processing section 24.

For example, the binding control section 26 controls the tape holding section 58 to thereby hold the tape T such that the adhesive surface of the tape T is inclined with respect to the inserting direction of the sheet bundle 5. In a state in which the tape holding section 58 holding the tape T in a position avoiding the recessed section 55*a* of the guide stand 55 is stopped, the binding control section 26 conveys the tape T with the tape conveying section 52 and bends the tape T in a curved state in the recessed section 55*a*. The binding control section 26 cuts the tape T with the cutter 56 after bending the tape T in the curve shape in the recessed section 55*a*.

Figure 4:
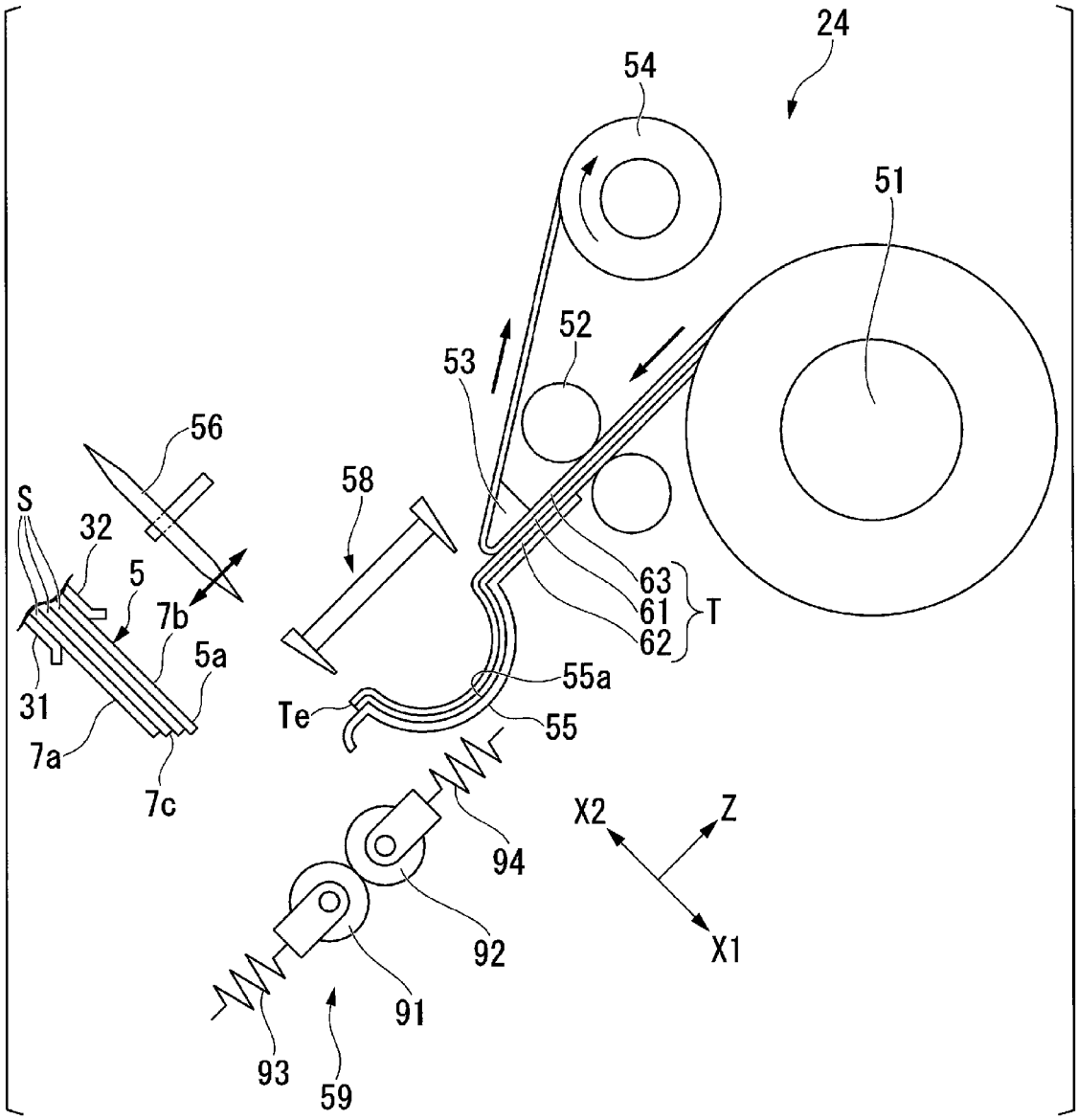
FIG. 4 is a front view illustrating the operation of the sheet binding apparatus.

An operation example of the sheet binding apparatus 3 is explained. FIGS. 4 to 10 are front views illustrating the operation example of the sheet binding apparatus 3. In FIG. 4 and the like, an example is illustrated in which the sheet bundle 5 is formed by four sheets S.

First, as illustrated in FIG. 2, the sheet binding apparatus 3 moves the stopper 33 to the restricting position to stop the sheet S conveyed to the main guide 31. Consequently, the plurality of sheets S are stacked in order and the sheet bundle 5 is formed. Subsequently, the sheet binding apparatus 3 moves the stopper 33 to the releasing position. The sheet binding apparatus 3 switches the switching member 34 toward the second conveying direction.

Subsequently, as illustrated in FIG. 3, the sheet binding apparatus 3 moves the second roller 42 toward the first roller 41. Consequently, the sheet bundle 5 and the outer circumferential surface 42*s* of the second roller 42 are deformed in an arcuate shape conforming to the outer circumferential surface 41*s* of the first roller 41. The sheet binding apparatus 3 normally rotates the first roller 41 in a state in which the sheet bundle 5 is held between the first roller 41 and the second roller 42.

Consequently, the second roller 42 rotates according to the rotation of the first roller 41 while maintaining a state in which the second roller 42 is recessed along the outer circumferential surface 41*s* of the first roller 41. As a result, a state is formed in which the plurality of sheets S are shifted in a step shape in the sheet conveying direction X1 at the edge portion 5*a* of the sheet bundle 5. "The edge portion 5*a* of the sheet bundle 5" in the following explanation means the edge portion 5*a* of the sheet bundle 5 in which the plurality of sheets S are shifted in a step shape.

Subsequently, the sheet binding apparatus 3 moves the second roller 42 is the direction away from the first roller 41. Consequently, the recess on the outer circumferential surface 42*s* of the second roller 42 is removed. Subsequently, the sheet binding apparatus 3 reversely rotates the first roller 41 and the second roller 42 to move the sheet bundle 5 in the opposite direction X2 of the sheet conveying direction X1. Subsequently, the sheet binding apparatus 3 switches the switching member 34 to switch the conveying path from the second conveying direction to the first conveying direction. The sheet binding apparatus 3 normally rotates the first roller 41 and the second roller 42 to move the sheet bundle 5 toward the tape attaching section 59.

As illustrated in FIG. 4, the sheet binding apparatus 3 according to this embodiment changes, based on the shift amount d between the sheets S changed by the binding control section 26, the length L of the tape T cut by the cutter 56. For example, in this embodiment, the binding control section 26 controls the driving source 73 of the cutting-length changing section 57, whereby the position of the cutter 56 is changed.

In this embodiment, the tape T conveyed along the guide stand 55 is bent in a curve shape by the recessed section 55*a* of the guide stand 55. A part of the tape T conveyed along the guide stand 55 bends along the recessed section 55*a* of the guide stand 55 with the own weight of the tape T.

Figure 5:
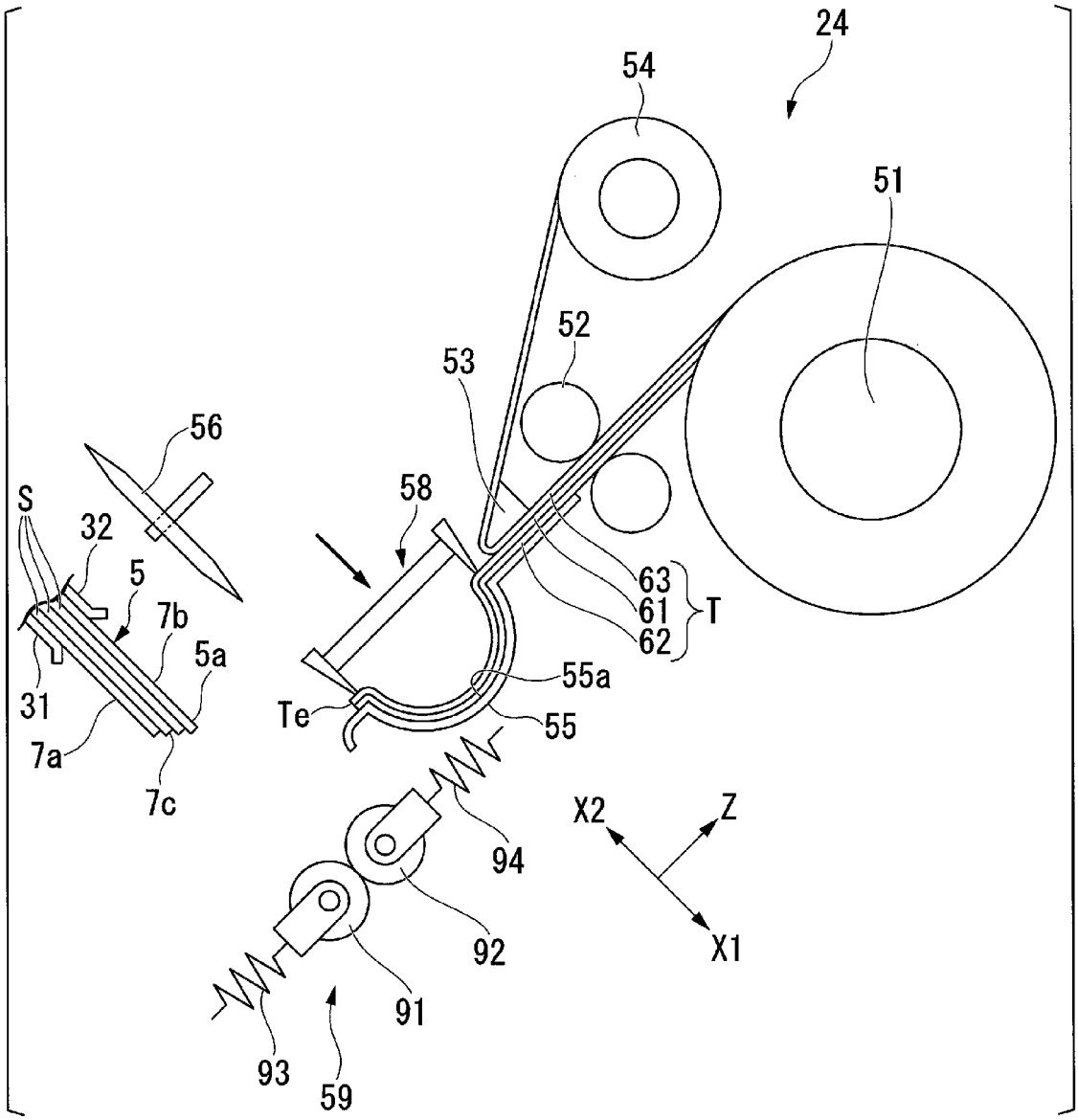
FIG. 5 is a front view illustrating the operation of the sheet binding apparatus following FIG. 4.

As illustrated in FIG. 5, the sheet binding apparatus 3 brings the tape holding section 58 into contact with the tape T to support the tape T in a state in which the posture of the tape T is retained. In this embodiment, the sheet binding apparatus 3 brings the tape holding section 58 into contact with both ends (an upstream end and a downstream end in the conveying direction of the tape T) of the recessed section 55*a* of the guide stand 55 to support the curve-shaped tape T. The tape holding section 58 holds the tape T in at least two parts. In this embodiment, the tape holding section 58 holds the curve-shaped tape T, which is held by the recessed section 55*a*, in two parts of the upstream end and the downstream end in the conveying direction of the tape T.

Figure 6:
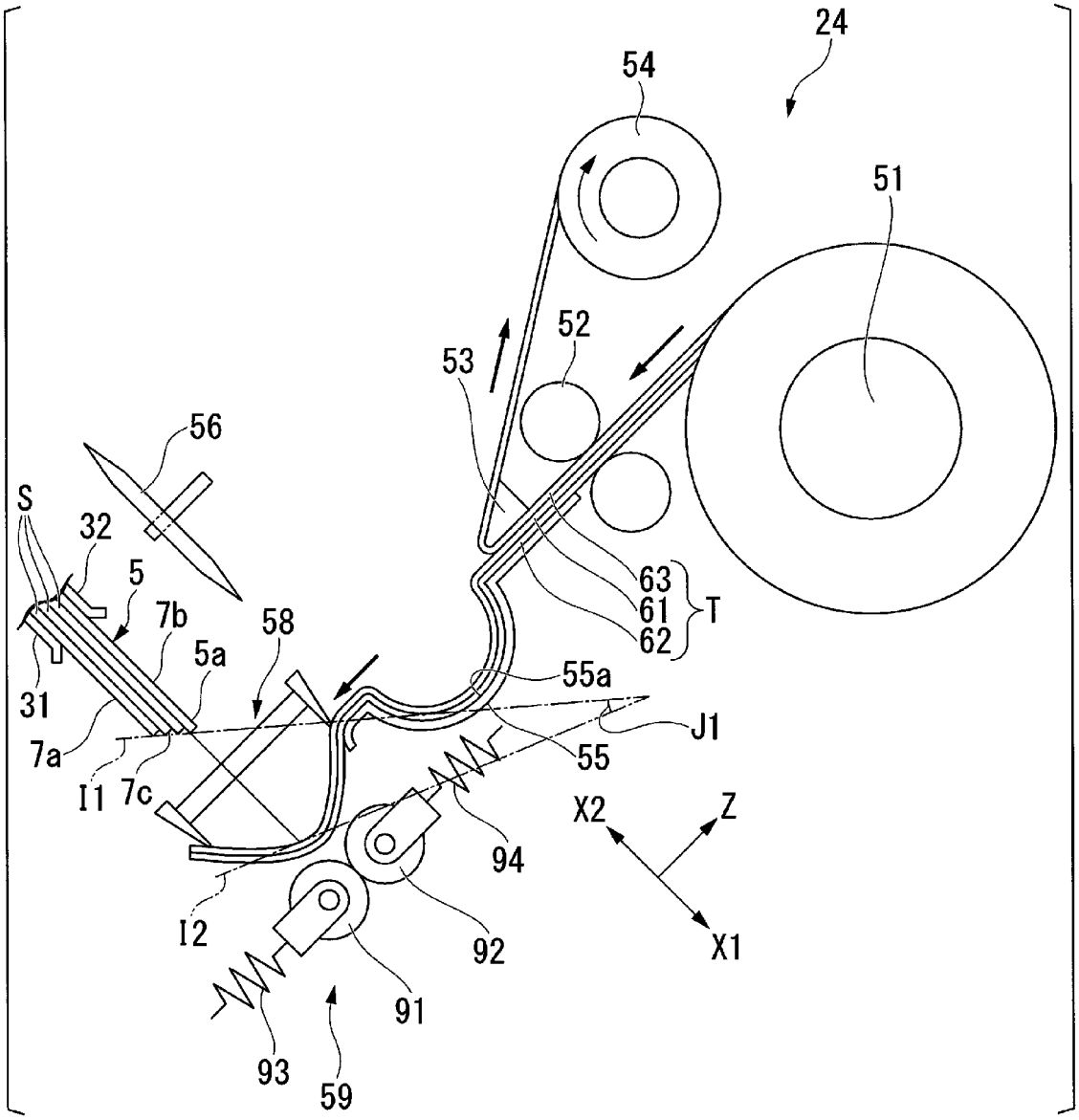
FIG. 6 is a front view illustrating the operation of the sheet binding apparatus following FIG. 5.

As illustrated in FIG. 6, the sheet binding apparatus 3 moves the tape holding section 58 to between the sheet bundle 5 and the tape attaching section 59. For example, the tape holding section 58 disposes the tape T to extend across the first roller 91 and the second roller 92. For example, the tape holding section 58 disposes the tape T such that the center of the curve-shaped tape T faces a nip between the first roller 91 and the second roller 92.

In this embodiment, the sheet binding apparatus 3 holds the tape T with the tape holding section 58 such that the adhesive surface of the tape T is inclined with respect to the inserting direction of the sheet bundle 5. For example, the tape holding section 58 holds the tape T such that an step-shaped end face 7*c* of the sheet bundle 5 faces the inclined surface of the tape T. In this embodiment, the step-shaped end face 7*c* of the sheet bundle 5 is opposed to the inclined surface of the curve-shaped tape T during tape attachment.

In FIG. 6, a sign I1 indicates a sheet bundle end face imaginary line passing the step-shaped end face 7*c* of the sheet bundle 5, a sign 12 indicates a tape inclined surface imaginary line passing the inclined surface of the curve-shaped tape T, and a sign J1 indicates an angle (also referred to as "holding angle") formed by the sheet bundle end face imaginary line and the tape inclined surface imaginary line. For example, the tape holding section 58 holds the tape T such that the holding angle J1 is 0° or more and less than 90° (an acute angle).

The sheet binding apparatus 3 holds the tape T with the tape holding section 58 in a position avoiding the recessed section 55*a* of the guide stand 55. A portion on the downstream side in the conveying direction of the tape T is referred to as "first portion" and a portion further on the upstream side than the first portion in the conveying direction of the tape T is referred to as "second portion". The sheet binding apparatus 3 conveys the tape T with the tape conveying section 52 in a state in which the tape holding section 58 holding the first portion of the tape T is stopped. The sheet binding apparatus 3 bends the second portion of the tape T in a curve shape in the recessed section 55*a*.

Figure 7:
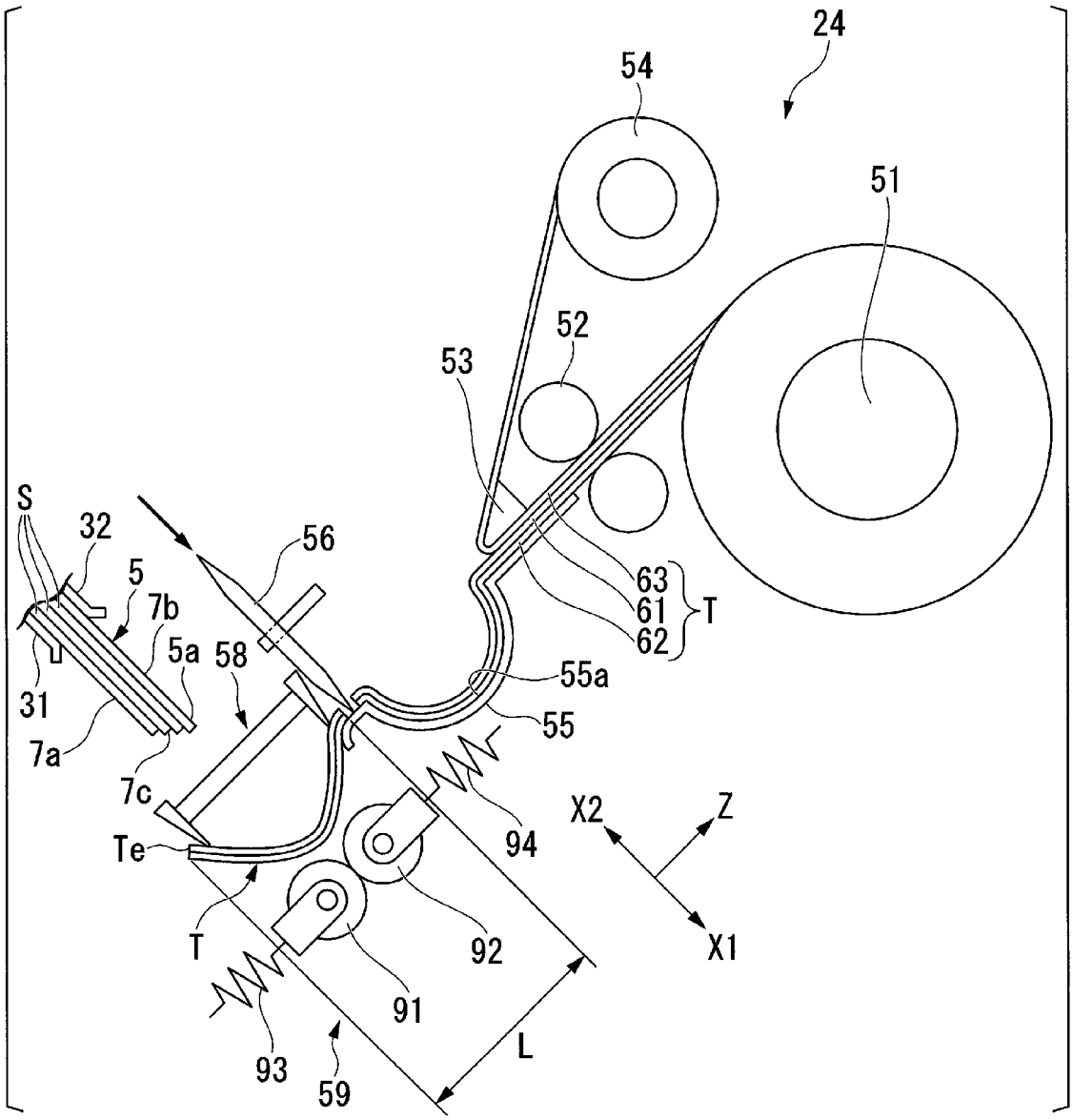
FIG. 7 is a front view illustrating the operation of the sheet binding apparatus following FIG. 6.

Subsequently, as illustrated in FIG. 7, the sheet binding apparatus 3 cuts the belt-like tape T with the cutter 56 and forms the sheet-like tape T. Consequently, the tape T is cut into a necessary length. In this embodiment, the sheet binding apparatus 3 cuts the tape T with the cutter 56 after bending the tape T in the curve shape in the recessed section 55*a* of the guide stand 55.

Figure 8:
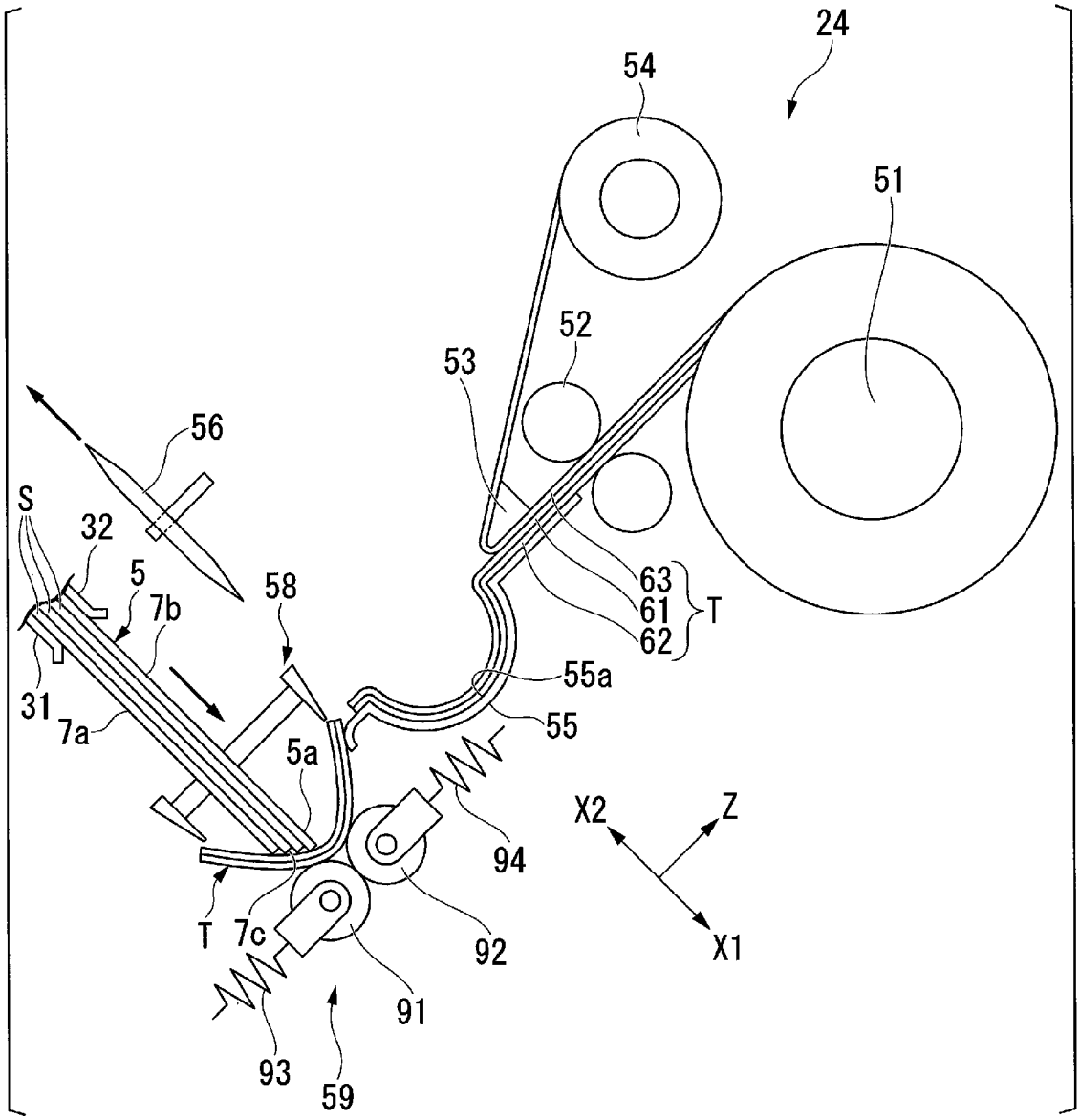
FIG. 8 is a front view illustrating the operation of the sheet binding apparatus following FIG. 7.

Subsequently, as illustrated in FIG. 8, the sheet binding apparatus 3 moves the sheet bundle 5 toward the tape attaching section 59 with the sheet shifting section 23. For example, the sheet binding apparatus 3 normally rotates the first roller 41 and the second roller 42 to move (insert) the sheet bundle 5 toward the tape attaching section 59.

The main guide 31 guides the sheet bundle 5 to between the two parts of the tape T held by the tape holding section 58. The sub-guide 32 is opposed to the main guide 31 across the sheet bundle 5. The main guide 31 and the sub-guide 32 function as a guide section that guides the sheet bundle 5 to between the two parts of the tape T. The tape holding section 58 bends and holds the tape T to be convex to the conveying direction downstream side of the sheet bundle 5 (the inserting direction of the sheet bundle 5). The sheet bundle 5 is guided by the main guide 31 and the sub-guide 32 such that the step-shaped end face 7*c* faces the inclined surface of the curve-shaped tape T.

The sheet binding apparatus 3 inclines the adhesive surface of the tape T with respect to the inserting direction of the sheet bundle 5 to set the holding angle J1 (see FIG. 6) to an acute angle. The sheet binding apparatus 3 causes the step-shaped end face 7*c* of the sheet bundle 5 to face the inclined surface of the tape T. The sheet binding apparatus 3 brings the plurality of sheets S forming the sheet bundle 5 into contact with the tape T. The sheet binding apparatus 3 inserts the sheet bundle 5 into the tape T held by the tape holding section 58 to thereby peel the tape T from the tape holding section 58. The sheet binding apparatus 3 inserts the edge portion 5*a* of the sheet bundle 5 between the first roller 91 and the second roller 92 together with the tape T.

Figure 9:
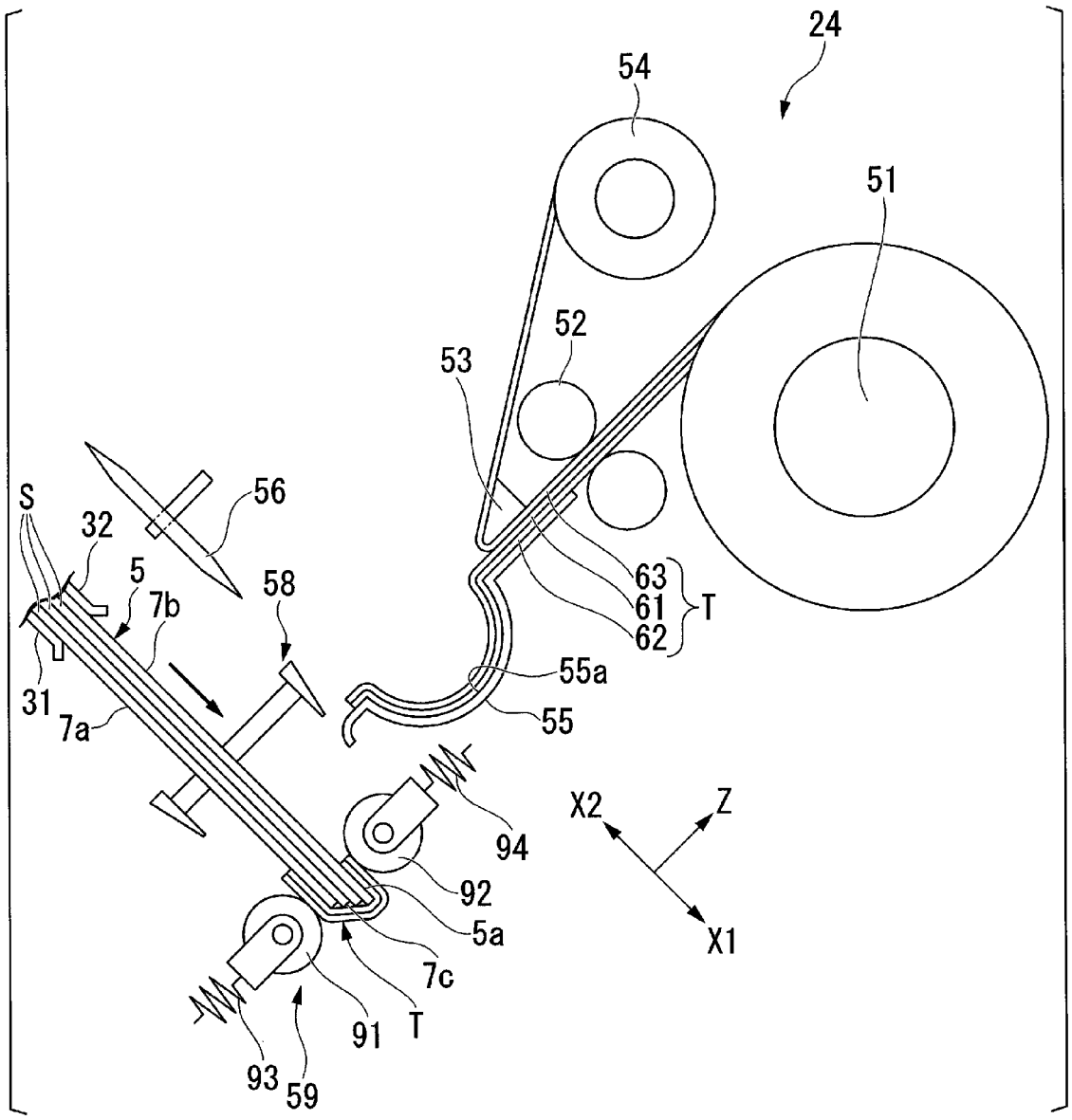
FIG. 9 is a front view illustrating the operation of the sheet binding apparatus following FIG. 8.

As illustrated in FIG. 9, if the edge portion 5*a* of the sheet bundle 5 is inserted between the first roller 91 and the second roller 92 together with the tape T, the first roller 91 and the second roller 92 move along the external shape of the edge portion 5*a* of the sheet bundle 5. Consequently, the first roller 91 and the second roller 92 press the tape T against the edge portion 5*a* of the sheet bundle 5. As a result, the tape T sequentially follows and adheres to a step-shaped portion of the sheet bundle 5. The edge portion 5*a* of the sheet bundle 5 includes a first surface 7*a*, a second surface 7*b*, and an end face 7*c*. The first surface 7*a* and the second surface 7*b* are surfaces extending along the sheet conveying direction X1. The second surface 7*b* is located on the opposite side of the first surface 7*a*. The end face 7*c* is located between the first surface 7*a* and the second surface 7*b*. The plurality of sheets S are shifted in a step shape on the end face 7*c*. The tape T is attached over the first surface 7*a*, the end face 7*c*, and the second surface 7*b* at the edge portion 5*a* of the sheet bundle 5. Consequently all the sheet S including the middle page of the sheet bundle 5 are integrated by the tape T. Consequently, processing for attaching the tape T to the edge portion 5*a* of the sheet bundle 5 is completed.

Figure 10:
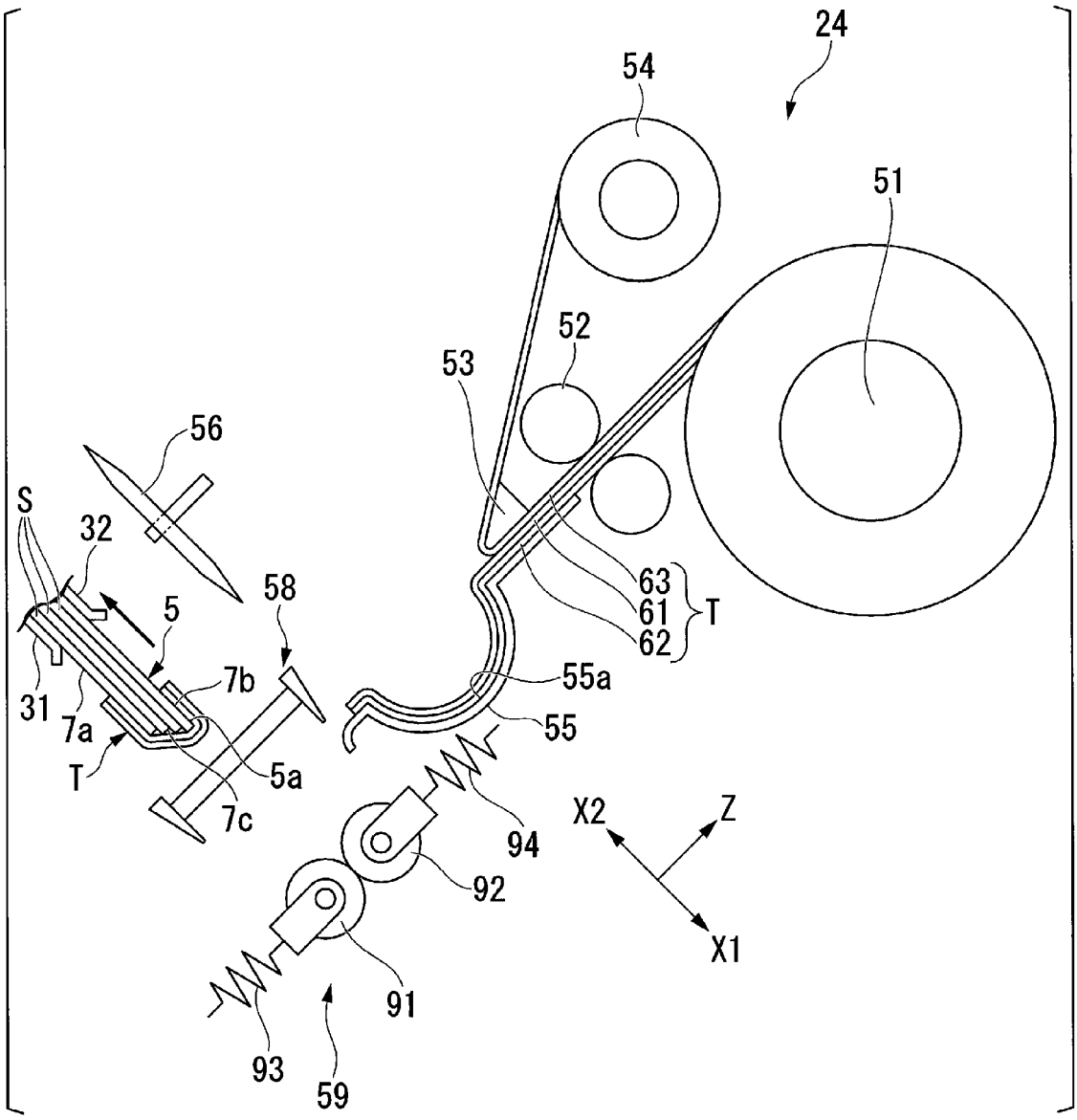
FIG. 10 is a front view illustrating the operation of the sheet binding apparatus following FIG. 9.

Subsequently, as illustrated in FIG. 10, the sheet binding apparatus 3 reversely rotates the first roller 41 and the second roller 42 to take out the sheet bundle 5 from between the first roller 91 and the second roller 92. The sheet binding apparatus 3 further reversely rotates the first roller 41 and the second roller 42 to discharge the sheet bundle 5 to the discharging section of the sheet binding apparatus 3.

Consequently, a series of operation by the sheet binding apparatus 3 ends.

The operation of a sheet binding apparatus in a comparative example is explained.

Figure 11:
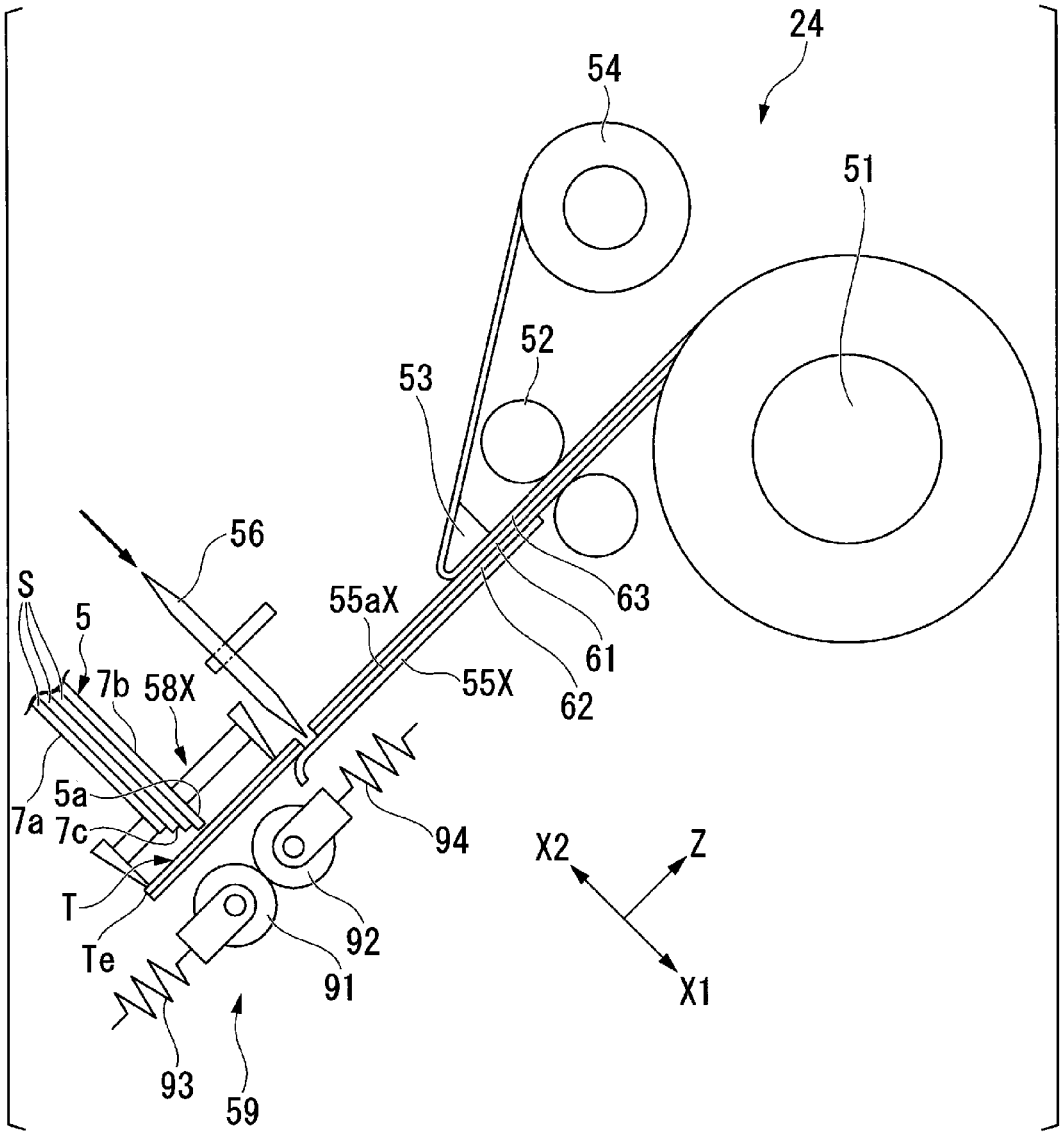
FIG. 11 is a front view illustrating the operation of a sheet binding apparatus in a comparative example.
Figure 12:
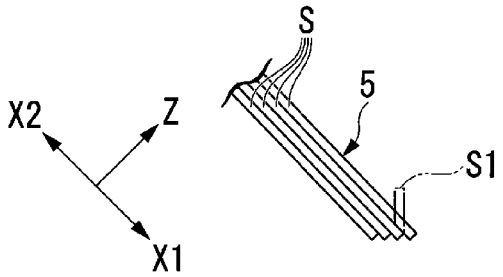
FIG. 12 is an explanatory diagram of a bend of a sheet in the comparative example.

FIG. 11 is a front view illustrating the operation of the sheet binding apparatus in the comparative example. FIG. 12 is an explanatory diagram of a bend of a sheet in the comparative example.

As illustrated in FIG. 11, a guide stand 55X of the sheet binding apparatus in the comparative example linearly extends along the conveying direction of the tape T. The guide stand 55X in the comparative example has a flat surface 55*a*X extending along the conveying direction of the tape T. The guide stand 55X in the comparative example does not include a recessed section for bending the tape T in the curve shape (the recessed section 55*a* in the embodiment).

The sheet binding apparatus in the comparative example brings a tape holding section 58X into contact with the tape T to support the tape T in a state in which the posture of the tape T is retained substantially flat. If the tape T is attached to the edge portion 5*a* of the sheet bundle 5, the sheet binding apparatus bumps a leading end (a projecting end) of the edge portion 5*a* of the sheet bundle 5 against the tape T. The sheet binding apparatus inserts the sheet bundle 5 toward the tape T held by the tape holding section 58X to thereby peel the tape T from the tape holding section 58X.

In the comparative example, if the tape T is peeled from the tape holding section 58X, the leading end of the edge portion 5*a* of the sheet bundle 5 shifted in the step shape bumps into the adhesive surface of the tape T. Therefore, it is highly likely that the sheet S yields to a force for peeling the tape T from the tape holding section 58X and is bent or turned up. In FIG. 12, a state in which the sheet S in the comparative example is bent. In FIG. 12, a state in which only a first sheet S1 projecting in the sheet conveying direction X1 most among the plurality of sheets S forming the sheet bundle 5 is bent is indicated by a broken line.

On the other hand, as illustrated in FIG. 8, the adhesive surface of the tape T is inclined with respect to the inserting direction of the sheet bundle 5 such that the step-shaped end face 7*c* of the sheet bundle 5 faces the inclined surface of the curve-shaped tape T. In this case, the plurality of sheets S forming the sheet bundle 5 come into contact with the tape T. In the embodiment, since a contact area of the sheet bundle 5 to the tape T is larger than the contact area in the comparative example, it is less likely that the edge portion 5*a* of the sheet bundle 5 yields to a force for peeling the tape T from the tape holding section 58. Therefore, it is less likely that the sheet S yields to the force for peeling the tape T from the tape holding section 58 and is bent or turned up.

According to the embodiment, the sheet binding apparatus 3 includes the tape holding section 58 and the guide section 31. The tape holding section 58 holds the tape T in at least the two parts. The guide section 31 guides the sheet bundle 5 to between the two parts of the tape T. The tape holding section 58 bends and holds the tape T to be convex to the conveying direction downstream side of the sheet bundle 5. With the configuration explained above, the following effect is obtained. The contact area of the sheet bundle 5 to the tape T is large compared with the configuration in which the leading end of the edge portion 5*a* of the sheet bundle 5 is bumped against the tape T (see FIG. 11). Therefore, it is possible to reduce likelihood that the edge portion 5*a* of the sheet bundle 5 yields to the force for peeling the tape T from the tape holding section 58. According to the embodiment, if the tape T is attached to the edge portion 5*a* of the sheet bundle 5, it is possible to incline the adhesive surface of the tape T with respect to the inserting direction of the sheet bundle 5 such that the step-shaped end face 7*c* of the sheet bundle 5 faces the inclined surface of the tape T. Consequently, it is possible to prevent only one of the plurality of sheets S forming the sheet bundle 5 from coming not contact with the tape T. That is, the tape T is peeled from the tape holding section 58 by the plurality of sheets S. It is less likely that the edge portion 5*a* of the sheet bundle 5 yields to the force for peeling the tape T from the tape holding section 58. Therefore, it is possible to suppress turn-up of the sheet S.

The sheet binding apparatus 3 further includes the guide stand 55 that forms the conveying path of the tape T. The guide stand 55 includes the recessed section 55*a* for holding the tape T to be bent in the curve shape. With the configuration explained above, the following effect is obtained. It is possible to bend the tape T in the curve shape with the action of the recessed section 55*a* of the guide stand 55. Consequently, it is possible to bring the plurality of sheets S forming the sheet bundle 5 into contact with the inclined surface of the curve-shaped tape T. Therefore, it is easy to suppress turn-up of the sheet S with the curve-shaped tape T.

The sheet binding apparatus 3 further includes the tape conveying section 52 and the binding control section 26. The tape conveying section 52 conveys the tape T. The binding control section 26 stops the tape holding section 58 holding the tape T in the position avoiding the recessed section 55*a* of the guide stand 55. In a state in which the tape holding section 58 is stopped, the binding control section 26 performs control to convey the tape T with the tape conveying section 52 and bend the tape T in the curve shape in the recessed section 55*a*. With the configuration explained above, the following effect is obtained. It is easy to bend the tape T in the curve shape in the recessed section 55*a* compared with when the tape T is conveyed by the tape conveying section 52 while moving the tape holding section 58.

The sheet binding apparatus 3 further includes the cutter 56 that cuts the tape T. The binding control section 26 cuts the tape T with the cutter 56 after bending the tape T in the curve shape in the recessed section 55*a* of the guide stand 55. With the configuration explained above, the following effect is obtained. It is easy to bend the tape T in the curve shape in the recessed section 55*a* compared with when the tape T is cut by the cutter 56 before the tape T is bent in the curve shape in the recessed section 55*a* of the guide stand 55. For example, it is possible to bend the second portion of the tape T in the curve shape in the recessed section 55*a* in a state in which the first portion of the preceding tape T is held by the tape holding section 58.

The conveying direction of the tape T crosses the vertical plane. The recessed section 55*a* of the guide stand 55 has the curve shape convex downward. With configuration explained above, the following effect is obtained. A part of the tape T conveyed along the guide stand 55 can be bent along the recessed section 55*a* of the guide stand 55 by the own weight of the tape T. Therefore, it is easy to bend the tape T in the curve shape in the recessed section 55*a*.

A modification of the first embodiment is explained.

The recessed section 55*a* is not limited to having the arcuate shape convex toward the conveying direction downstream side of the sheet bundle 5 (the sheet conveying direction X1). For example, the recessed section 55*a* may have a triangular shape or a rectangular shape convex toward the conveying direction downstream side of the sheet bundle 5. That is, the recessed section 55*a* only has to bend and hold the tape T to be convex to the conveying direction downstream side of the sheet bundle 5.

The guide stand 55 is not limited to including the recessed section 55*a* that holds the tape T to be bent in the curve shape. For example, a hole section (a through-hole) for bending the tape T in the curve shape may be provided in the guide stand 55. A holding member for holding the tape T bent by the through-hole may be provided below the through-hole.

In FIG. 4 and the like, the example is explained in which the sheet bundle 5 is formed by the four sheets S. However, not only this, but, for example, the number of the sheets S forming the sheet bundle 5 may be ten to twenty. For example, the number of the sheets S forming the sheet bundle 5 may be only two. That is, the sheet bundle 5 only has to be formed by the plurality of sheets S.

A second embodiment is explained with reference to FIGS. 13 to 18. In the second embodiment, explanation is omitted concerning the same components as the components in the first embodiment.

The guide stand is not limited to including the recessed section for holding the tape to be bent in the curve shape. The second embodiment is different from the first embodiment in that a pair of tape supporting sections is moved to bend the tape in the curve shape.

Figure 13:
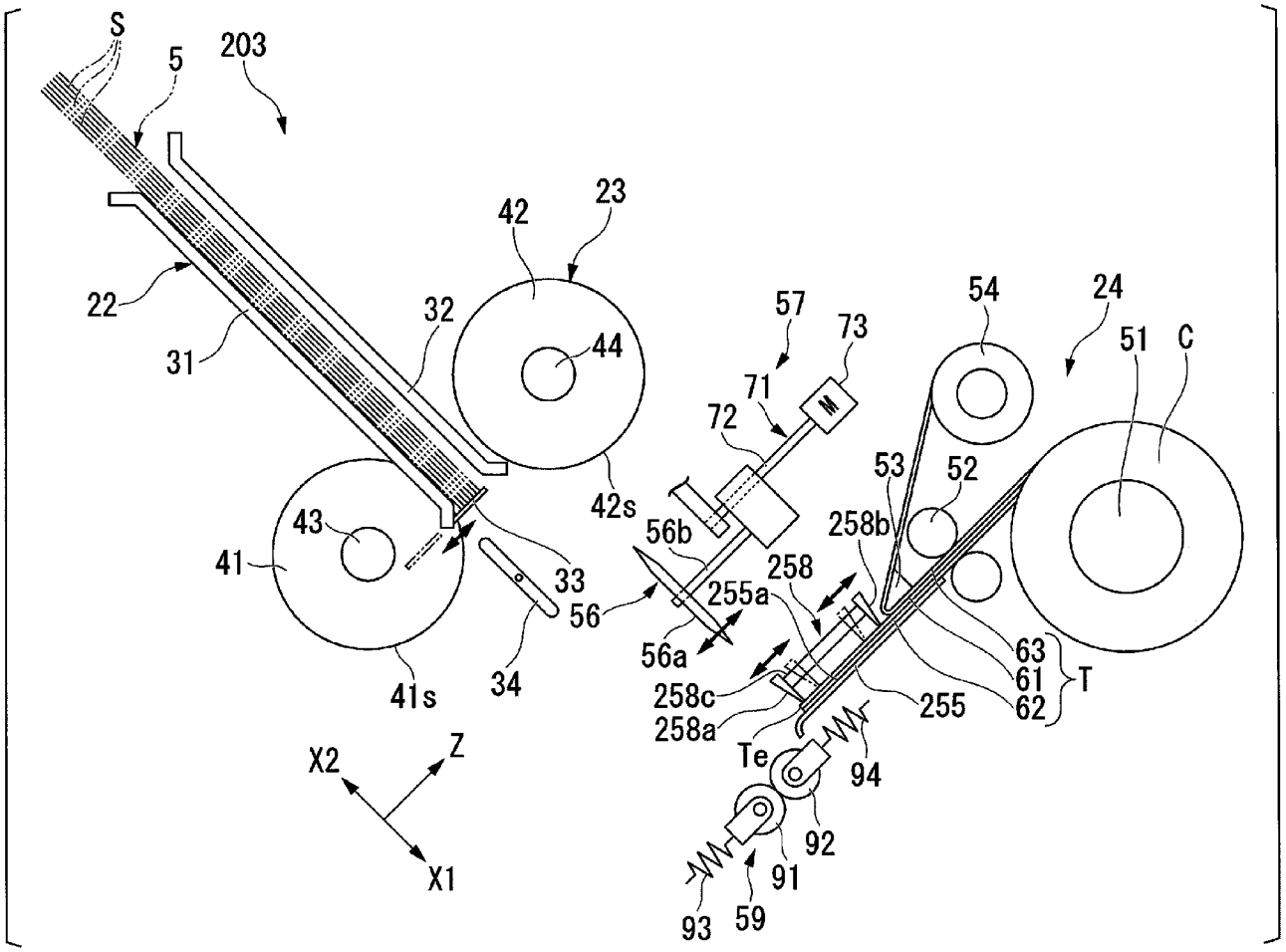
FIG. 13 is a front view illustrating an internal configuration of a sheet binding apparatus according to a second embodiment.

FIG. 13 is a front view illustrating a sheet binding apparatus 203 according to the second embodiment.

As illustrated in FIG. 13, the sheet binding apparatus 203 includes a guide stand 255 linearly extending along the conveying direction of the tape T. The guide stand 255 includes a flat surface 255*a* extending along the conveying direction of the tape T.

A tape holding section 258 includes a first tape supporting section 258*a*, a second tape supporting section 258*b*, and a supporting-section coupling section 258*c*.

The first tape supporting section 258*a* and the second tape supporting section 258*b* support the tape T.

The supporting-section coupling section 258*c* couples the first tape supporting section 258*a* and the second tape supporting section 258*b* to enable the first tape supporting section 258*a* and the second tape supporting section 258*b* to approach and separate from each other. The supporting-section coupling section 258*c* extends along the length direction of the tape T.

Each of the first tape supporting section 258*a* and the second tape supporting section 258*b* is movable along the extending direction of the supporting-section coupling section 258*c* by a not-illustrated moving mechanism. The first tape supporting section 258*a* and the second tape supporting section 258*b* are movable by a not-illustrated moving mechanism in a direction in which the first tape supporting section 258*a* and the second tape supporting section 258*b* approach each other and a direction in which the first tape supporting section 258*a* and the second tape supporting section 258*b* separate from each other.

For example, the binding control section 26 holds the tape T with the tape holding section 258 such that the adhesive surface of the tape T is inclined with respect to the inserting direction of the sheet bundle 5. In a state in which the first tape supporting section 258*a* and the second tape supporting section 258*b* are supporting the tape T, the binding control section 26 moves at least one of the first tape supporting section 258*a* and the second tape supporting section 258*b* to thereby bend the tape T in the curve shape. After cutting the tape T with the cutter 56, the binding control section 26 moves at least one of the first tape supporting section 258*a* and the second tape supporting section 258*b* to thereby bend the tape T in the curve shape.

An operation example of the sheet binding apparatus 203 according to the second embodiment is explained. FIGS. 14 to 18 are front views illustrating the operation example of the sheet binding apparatus 203. In the second embodiment, explanation is omitted concerning the same operations as the operations in the first embodiment.

Figure 14:
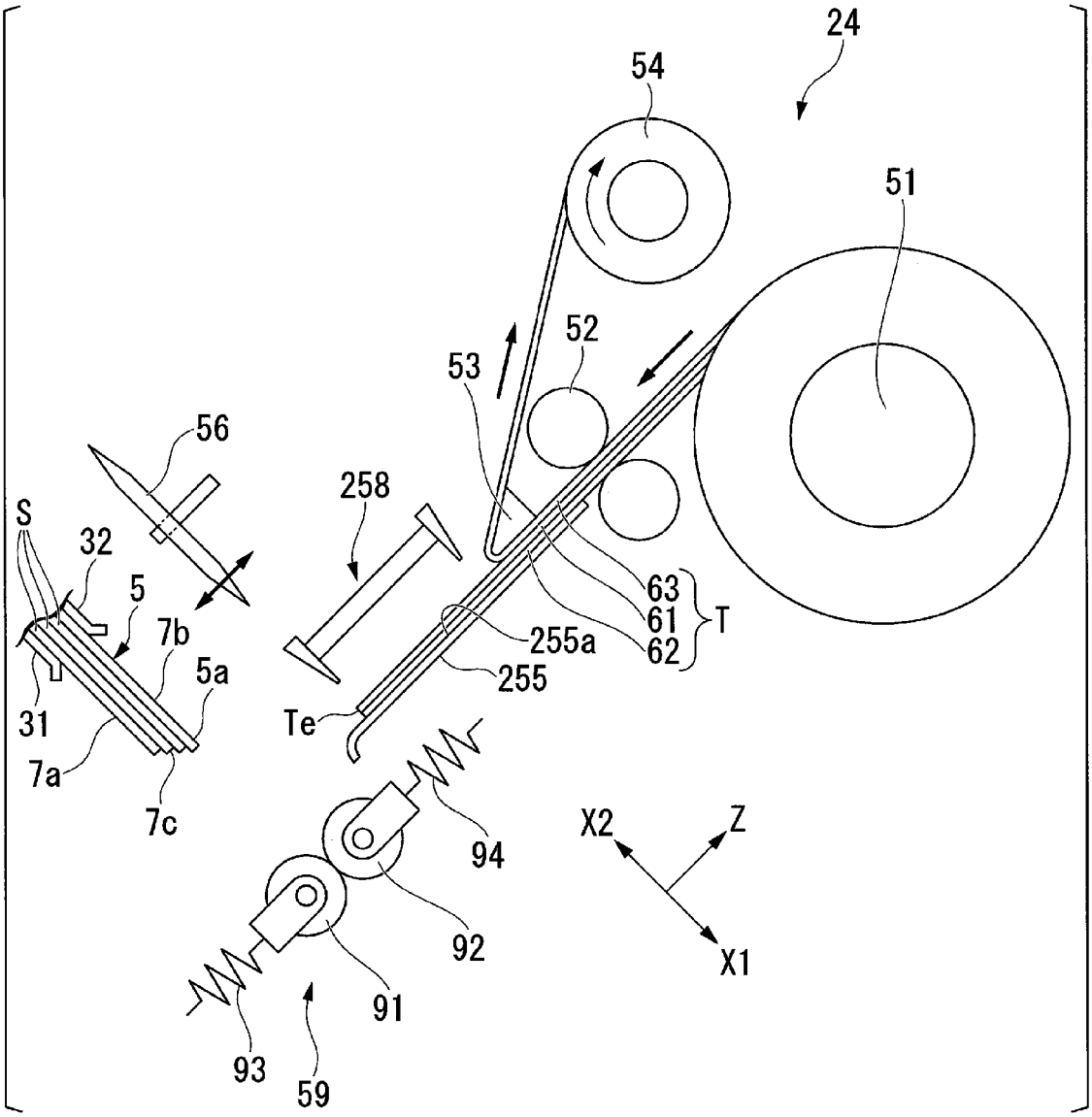
FIG. 14 is a front view illustrating the operation of the sheet binding apparatus.

As illustrated in FIG. 14, in this embodiment, the tape T conveyed along the guide stand 255 is held substantially flat by the flat surface 255*a* of the guide stand 255. The tape T conveyed along the guide stand 255 linearly extends along the flat surface 255*a* of the guide stand 255 with the own weight of the tape T.

Figure 15:
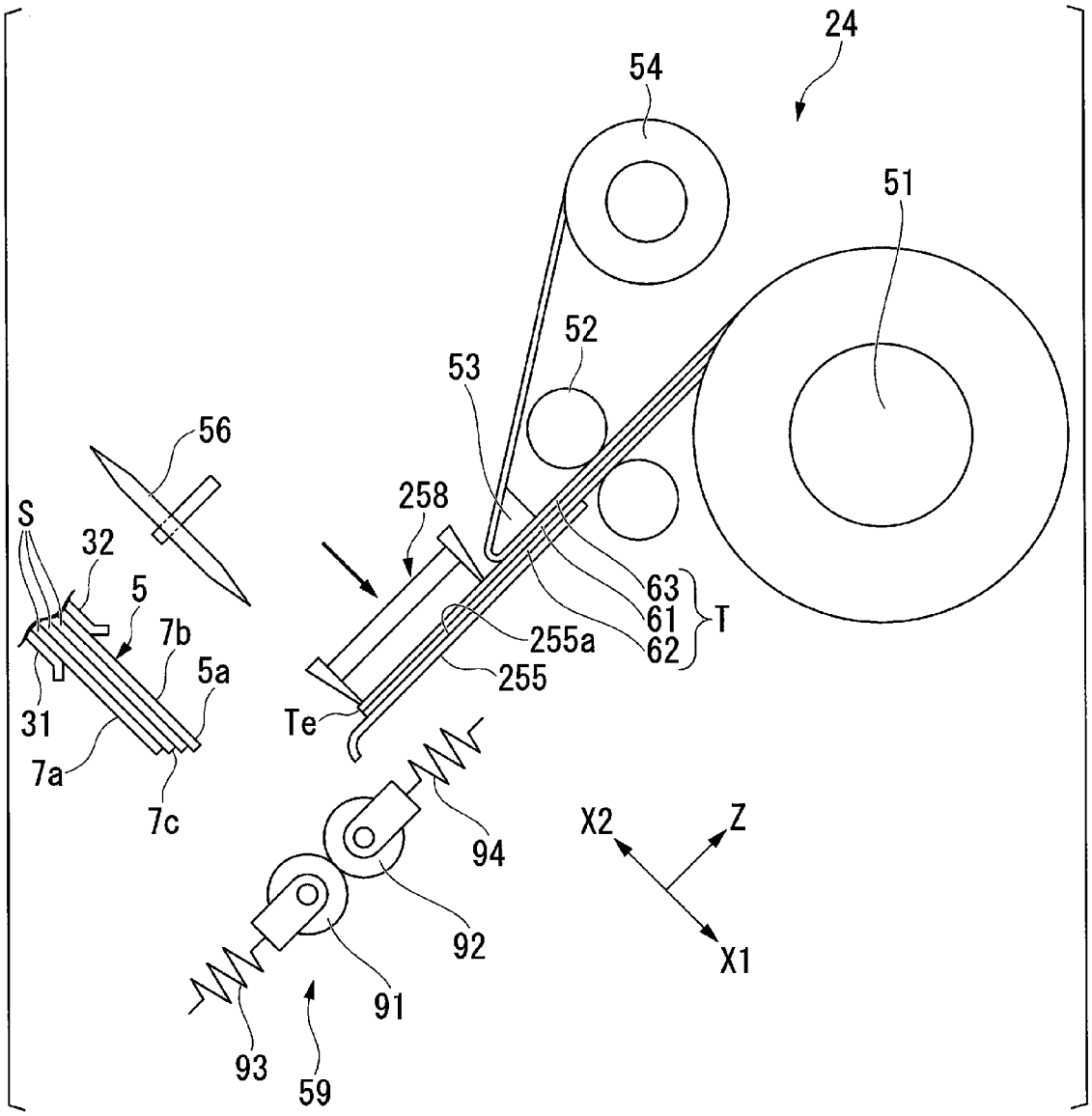
FIG. 15 is a front view illustrating the operation of the sheet binding apparatus following FIG. 14.

As illustrated in FIG. 15, the sheet binding apparatus 203 brings the tape holding section 258 into contact with the tape T to support the tape T in a state in which the posture of the tape T is retained. In this embodiment, the tape holding section 258 is brought into contact with the flat surface 255*a* of the guide stand 255 to retain the posture of the tape T substantially flat. In this embodiment, the tape holding section 258 holds the linear tape T, which is held by the flat surface 255*a*, in two parts at an upstream end and a downstream end in the conveying direction of the tape T.

Figure 16:
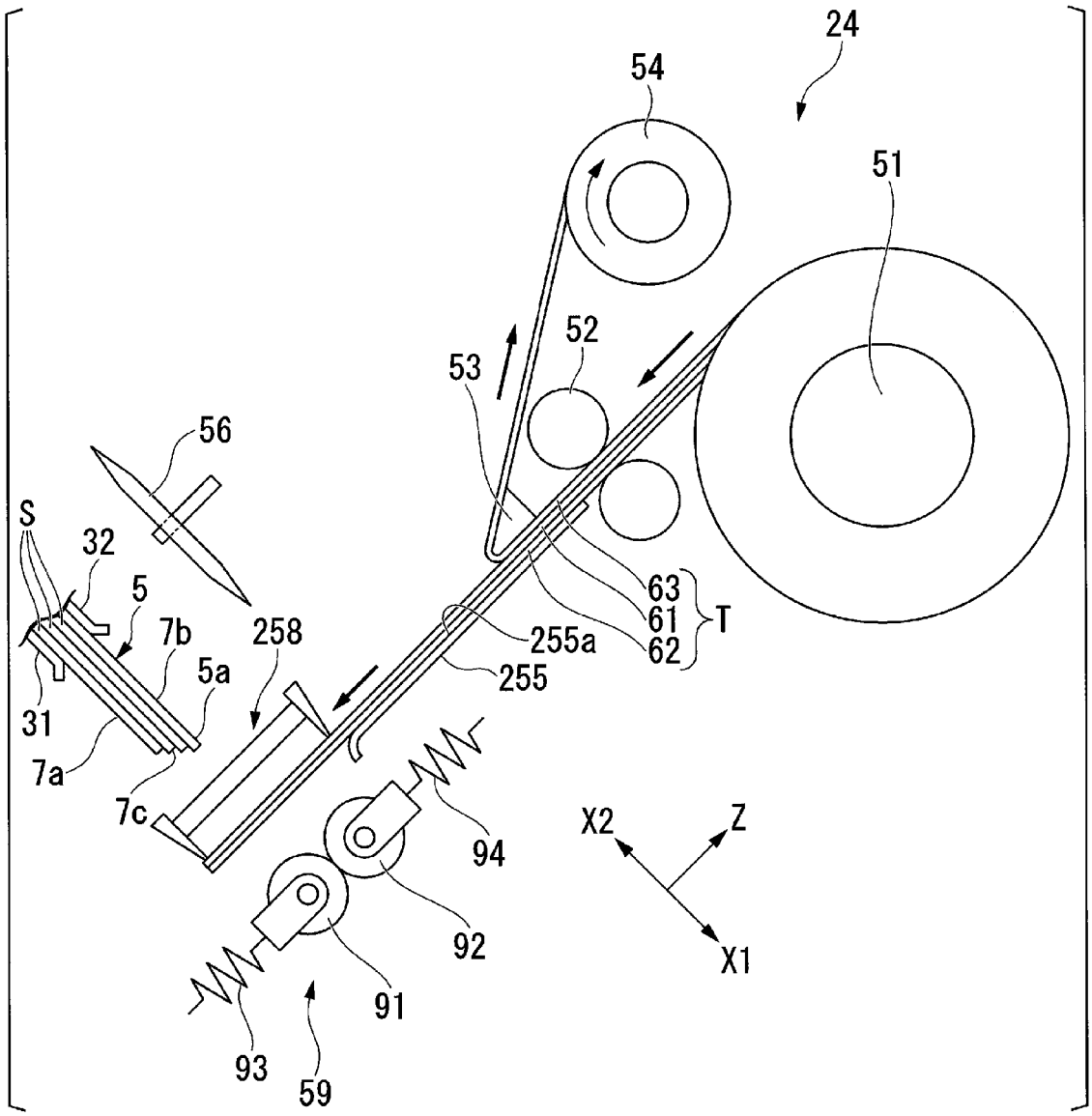
FIG. 16 is a front view illustrating the operation of the sheet binding apparatus following FIG. 15.

As illustrated in FIG. 16, the sheet binding apparatus 203 move the tape holding section 258 to between the sheet bundle 5 and the tape attaching section 59. For example, the tape holding section 258 disposes the tape T to extend across the first roller 91 and the second roller 92. For example, the tape holding section 258 disposes the tape T such that the center of the substantially flat tape T faces the nip between the first roller 91 and the second roller 92.

Figure 17:
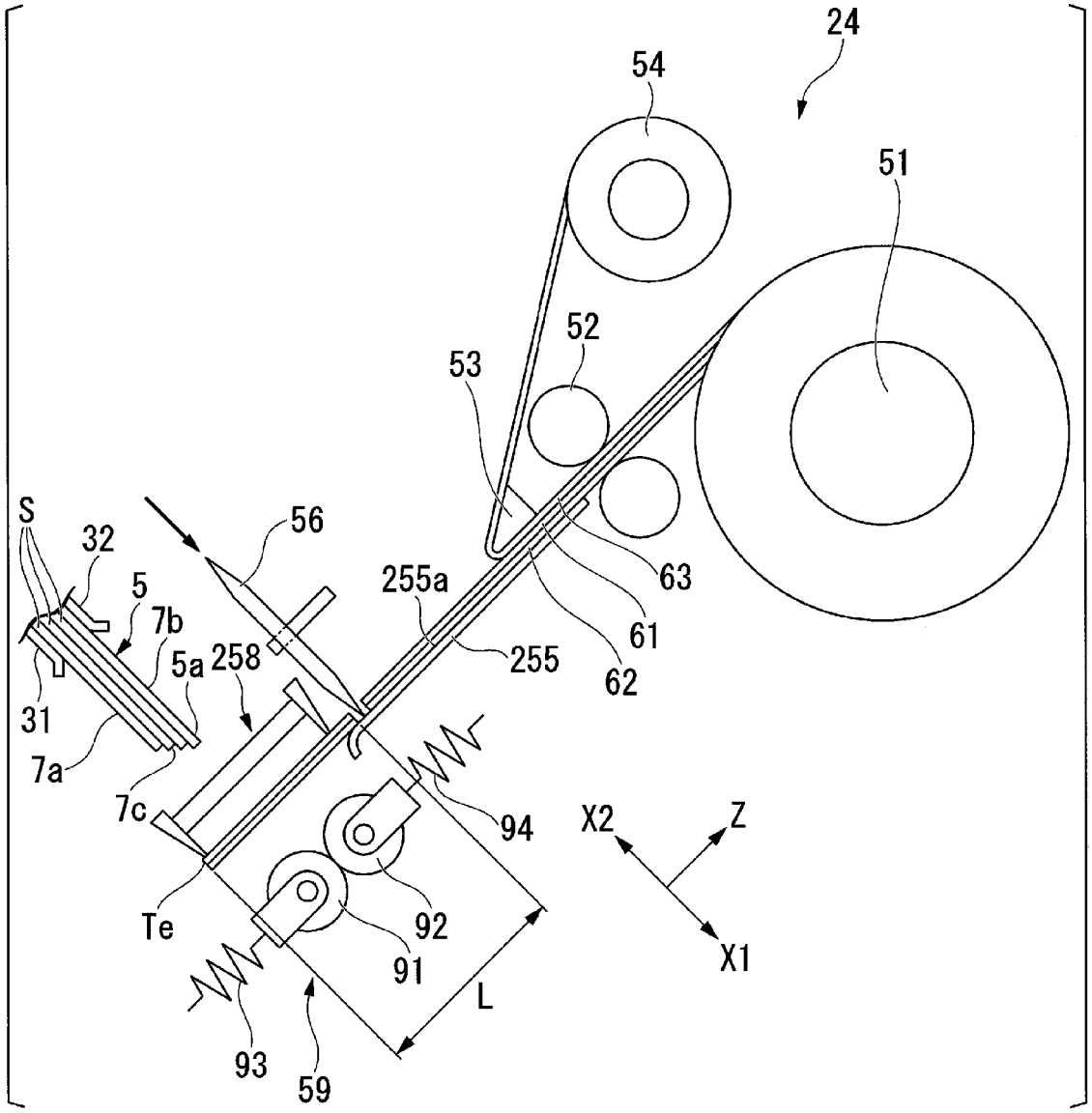
FIG. 17 is a front view illustrating the operation of the sheet binding apparatus following FIG. 16.

As illustrated in FIG. 17, the sheet binding apparatus 203 cuts the belt-like tape T with the cutter 56 and forms the sheet-like tape T. Consequently, the tape T is cut into a necessary length.

Figure 18:
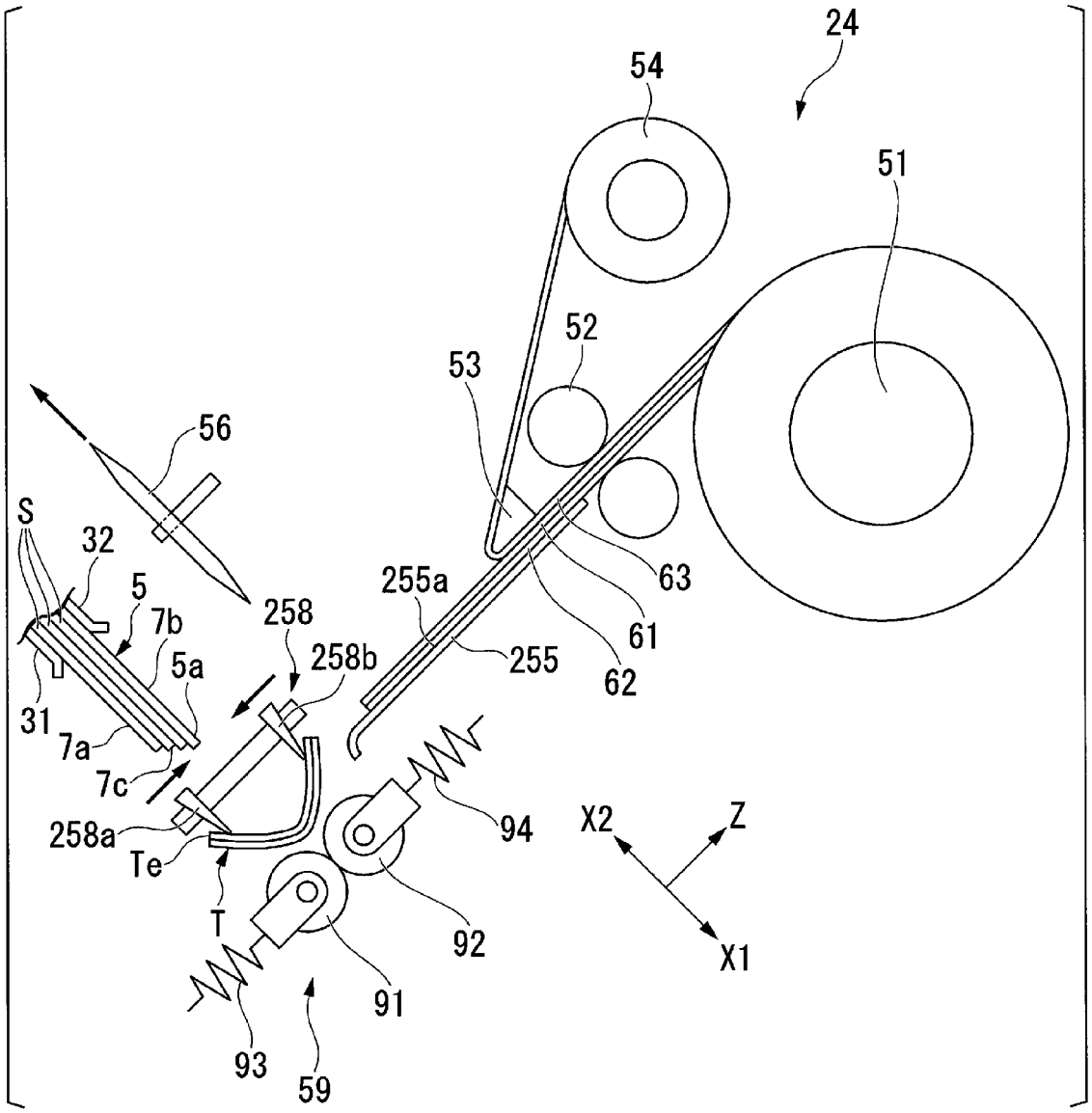
FIG. 18 is a front view illustrating the operation of the sheet binding apparatus following FIG. 17.

Subsequently, as illustrated in FIG. 18, the sheet binding apparatus 203 holds the tape T with the tape holding section 258 such that the adhesive surface of the tape T is inclined with respect to the inserting direction of the sheet bundle 5. For example, the tape holding section 258 holds the tape T such that the step-shaped end face 7*c* of the sheet bundle 5 faces the inclined surface of the curve-shaped tape T. For example, the tape holding section 258 holds the tape T such that the holding angle J1 is 0° or more and smaller than 90° (an acute angle).

In this embodiment, in a state in which the first tape supporting section 258*a* and the second tape supporting section 258*b* are supporting the tape T, the sheet binding apparatus 203 moves both of the first tape supporting section 258*a* and the second tape supporting section 258*b* to thereby bend the tape T in the curve shape. After cutting the tape T with the cutter 56, the sheet binding apparatus 203 moves both of the first tape supporting section 258*a* and the second tape supporting section 258*b* to thereby bend the tape T in the curve shape. In this embodiment, the sheet binding apparatus 203 causes both of the first tape supporting section 258*a* and the second tape supporting section 258*b* to approach each other to thereby bend the tape T in the curve shape.

Figure 19:
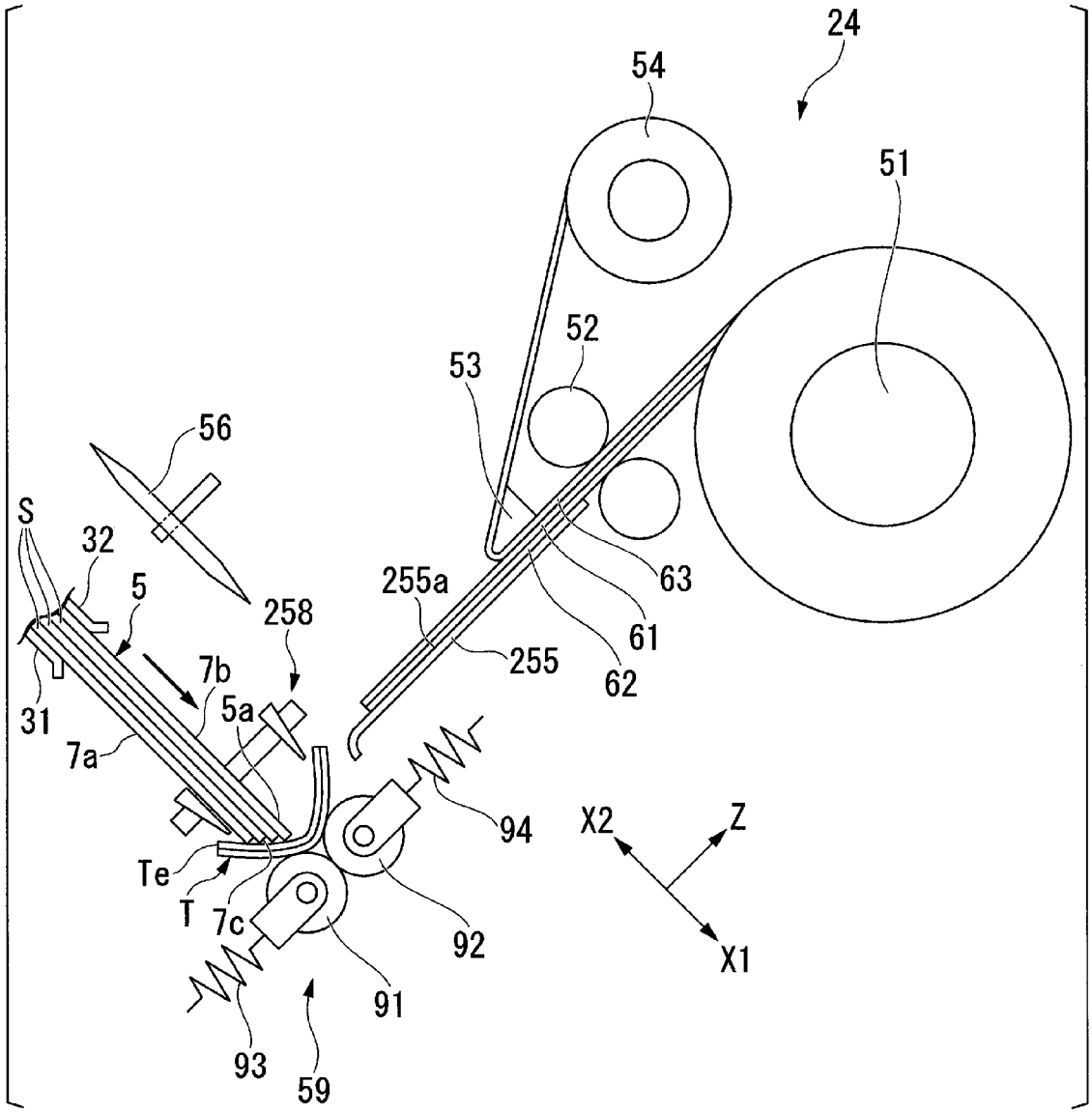
FIG. 19 is a front view illustrating the operation of the sheet binding apparatus following FIG. 18.

Subsequently, as illustrated in FIG. 19, the sheet binding apparatus 203 moves the sheet bundle 5 toward the tape attaching section 59 with the sheet shifting section 23. For example, the sheet binding apparatus 203 normally rotates the first roller 41 and the second roller 42 to move (insert) the sheet bundle 5 toward the tape attaching section 59.

The main guide 31 guides the sheet bundle 5 to between the two parts of the tape T held by the tape holding section 258. The tape holding section 258 bends and holds the tape T to be convex to the conveying direction downstream side of the sheet bundle 5 (the inserting direction of the sheet bundle 5). The sheet bundle 5 is guided by the main guide 31 and the sub-guide 32 such that the step-shaped end face 7*c* faces the inclined surface of the curve-shaped tape T.

The sheet binding apparatus 203 inclines the adhesive surface of the tape T with respect to the inserting direction of the sheet bundle 5 such that the step-shaped end face 7*c* of the sheet bundle 5 faces the inclined surface of the curve-shaped tape T. The sheet binding apparatus 203 brings the plurality of sheets S forming the sheet bundle 5 into contact with the tape T. The sheet binding apparatus 203 inserts the sheet bundle 5 into the tape T held by the tape holding section 258 to thereby peel the tape T from the tape holding section 258. The sheet binding apparatus 203 inserts the edge portion 5*a* of the sheet bundle 5 between the first roller 91 and the second roller 92 together with the tape T.

According to the second embodiment, the tape holding section 258 includes the first tape supporting section 258*a* and the second tape supporting section 258*b* that are supporting the tape T. In a state in which the first tape supporting section 258*a* and the second tape supporting section 258*b* are supporting the tape T, the binding control section 26 moves both of the first tape supporting section 258*a* and the second tape supporting section 258*b* to thereby bend the tape T in the curve shape. With the configuration explained above, the following effect is obtained. It is possible to bent the tape T in the curve shape with a simple configuration that makes use of the movement of the first tape supporting section 258*a* and the second tape supporting section 258*b*.

After cutting the tape T with the cutter 56, the binding control section 26 moves both of the first tape supporting section 258*a* and the second tape supporting section 258*b* to thereby bend the tape T in the curve shape. With the configuration explained above, the following effect is obtained. It is easy to cut the tape T straight compared with when the tape T is cut by the cutter 56 after the first tape supporting section 258*a* and the second tape supporting section 258*b* are moved. That is, during the cutting of the tape T, it is possible to eliminate the influence of a bend and the like of the tape T by the movement of the first tape supporting section 258*a* and the second tape supporting section 258*b*.

The tape holding section 258 further includes the supporting-section coupling section 258*c* that couples the first tape supporting section 258*a* and the second tape supporting section 258*b* to be capable of approaching and separating from each other. With the configuration explained above, the following effect is obtained. It is possible to bend the tape T in the curve shape with a simple configuration that makes use of reciprocation (advance and retraction) of the first tape supporting section 258*a* and the second tape supporting section 258*b*.

A modification of the second embodiment is explained.

The tape holding section 258 is not limited to including the supporting-section coupling section 258*c* that couples the first tape supporting section 258*a* and the second tape supporting section 258*b* to be capable of approaching and separating from each other.

Figure 20:
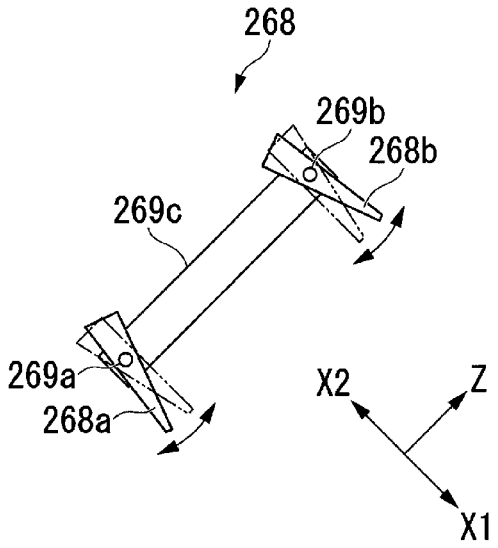
FIG. 20 is a front view illustrating a tape holding section in a modification of the second embodiment.
Figure 21:
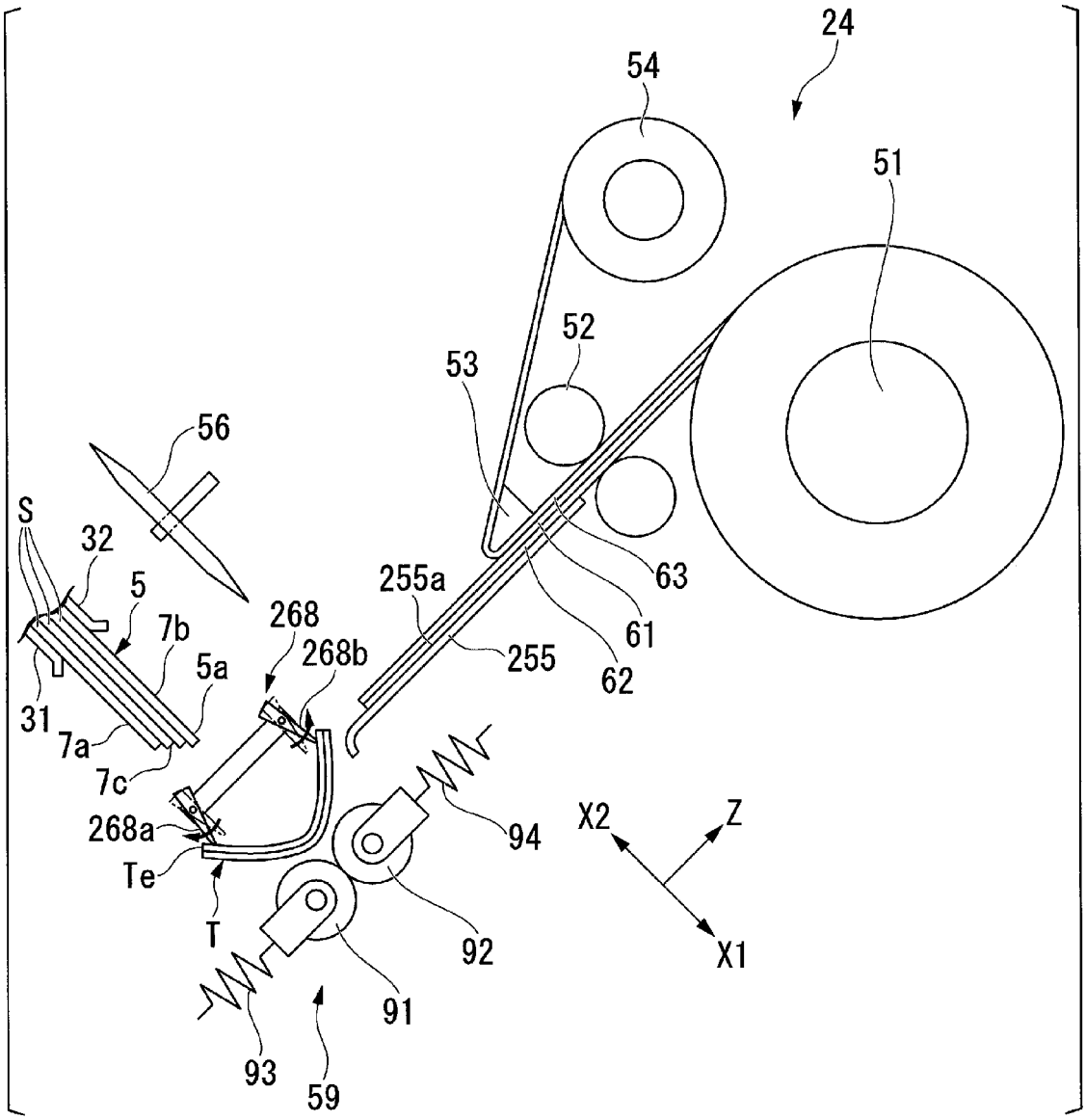
FIG. 21 is a front view illustrating the operation of a sheet binding apparatus.

FIG. 20 is a front view illustrating a tape holding section 268 in the modification of the second embodiment. FIG. 21 is a front view illustrating the operation of a sheet binding apparatus in the modification of the second embodiment.

As illustrated in FIG. 20, the tape holding section 268 may further include a first shaft 269*a* that rotatably supports a first tape supporting section 268*a* and a second shaft 269*b* that rotatably supports a second tape supporting section 268*b*. Each of the first tape supporting section 268*a* and the second tape supporting section 268*b* is rotatable around the shaft 269*a* or 269*b* by a not-illustrated moving mechanism. The first tape supporting section 268*a* and the second tape supporting section 268*b* are movable by a not-illustrated moving mechanism in a direction in which the first tape supporting section 268*a* and the second tape supporting section 268*b* approach each other and a direction in which the first tape supporting section 268*a* and the second tape supporting section 268*b* separate from each other. In FIG. 20, a sign 269*c* indicates a shaft coupling section that couples the first shaft 269*a* and the second shaft 269*b*.

As illustrated in FIG. 21, in this modification, in a state in which the first tape supporting section 268*a* and the second tape supporting section 268*b* are supporting the tape T, the sheet binding apparatus respectively rotates the first tape supporting section 268*a* and the second tape supporting section 268*b* to thereby bend the tape T in the curve shape. After cutting the tape T with the cutter 56, the sheet binding apparatus respectively rotates the first tape supporting section 268*a* and the second tape supporting section 268*b* to thereby bend the tape T in the curve shape. In this modification, the sheet binding apparatus separates the first tape supporting section 268*a* and the second tape supporting section 268*b* from each other to thereby bend the tape T in the curve shape.

According to this modification, it is possible to bend the tape T in the curve shape with a simple configuration that makes use of the rotation of the first tape supporting section 268*a* and the second tape supporting section 268*b*.

Another modification of the second embodiment is explained.

The binding control section is not limited to moving both of the first tape supporting section and the second tape supporting section. For example, the binding control section may move only at least one of the first tape supporting section and the second tape supporting section. That is, the binding control section only has to move at least one of the first tape supporting section and the second tape supporting section.

A third embodiment is explained with reference to FIGS. 22 to 29. In the third embodiment, explanation is omitted concerning the same components as the components in the second embodiment.

The binding control section is not limited to holding the curve-shaped tape with the tape holding section. The third embodiment is different from the second embodiment in that a linear tape is held by the tape holding section.

Figure 22:
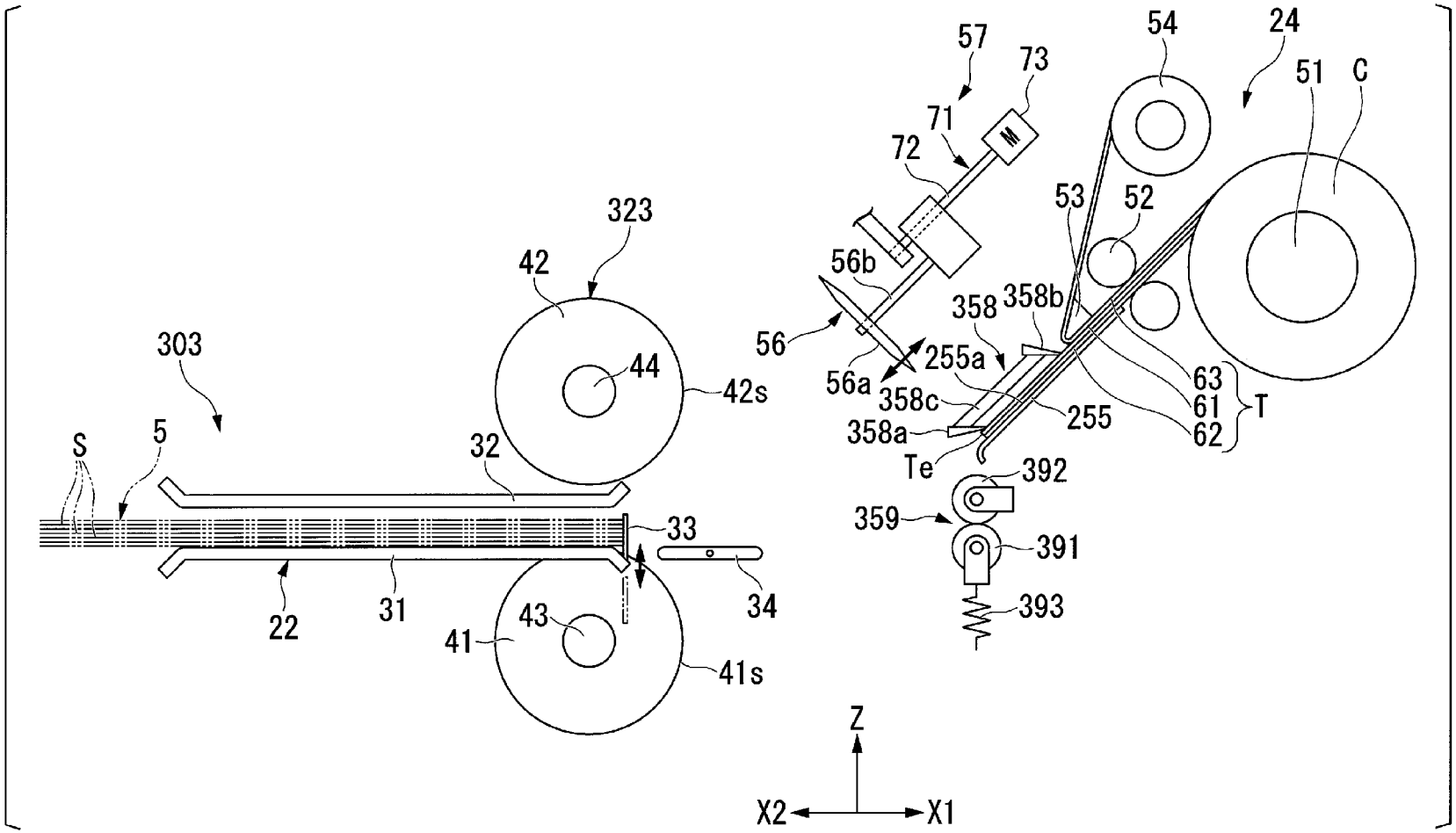
FIG. 22 is a front view illustrating an internal configuration of a sheet binding apparatus according to a third embodiment.

FIG. 22 is a front view illustrating a sheet binding apparatus 303 according to the third embodiment.

As illustrated in FIG. 22, the sheet binding apparatus 303 includes a sheet shifting section 323 that substantially horizontally moves the sheet bundle 5. In this embodiment, the sheet conveying direction X1 is substantially parallel to the horizontal direction.

The sheet binding apparatus 303 includes a tape holding section 358 that holds a linear tape T. The tape holding section 358 includes a first tape supporting section 358*a* and a second tape supporting section 358*b* that support the tape T. Each of the first tape supporting section 358*a* and the second tape supporting section 358*b* extends along the inserting direction of the sheet bundle 5 (the sheet conveying direction X1). In this embodiment, each of the first tape supporting section 358*a* and the second tape supporting section 358*b* substantially horizontally extends. The first tape supporting section 358*a* and the second tape supporting section 358*b* are disposed to be spaced apart from each other in the conveying direction of the tape T. Each of the first tape supporting section 358*a* and the second tape supporting section 358*b* has a sharp shape tapered toward the adhesive surface of the tape T. In FIG. 22, a sign 358*c* indicates a supporting-section coupling section that couples the first tape supporting section 358*a* and the second tape supporting section 358*b*.

The sheet binding apparatus 303 includes a tape attaching section 359 that attaches the tape T to the edge portion 5*a* of the sheet bundle 5. The tape attaching section 359 includes a first roller 391, a second roller 392, and a spring 393. The first roller 391 and the second roller 392 are disposed side by side in the vertical direction. The spring 393 urges the first roller 391 toward the second roller 392. The first roller 391 and the spring 393 form an example of an "urging section" in cooperation with each other. If the tape T is attached, the edge portion 5*a* of the sheet bundle 5 is inserted between the first roller 391 and the second roller 392 together with the tape T. Consequently, the tape T is bent by the tape attaching section 359 to wrap the edge portion 5*a* of the sheet bundle 5. The tape T is attached to the edge portion 5*a* of the sheet bundle 5.

For example, the binding control section 26 holds the tape T with the tape holding section 358 such that the adhesive surface of the tape T is inclined with respect to the inserting direction of the sheet bundle 5. The binding control section 26 holds the linear tape T with the tape holding section 358 and enables the sheet bundle 5 to be inserted while tilting the sheet bundle 5 by a shift angle of the edge portion 5*a* of the sheet bundle 5 respect to the adhesive surface of the tape T. The shift angle of the edge portion 5*a* of the sheet bundle 5 means an angle A1 formed by an imaginary straight line K1 passing a corner of a first sheet S1 and a corner of a second sheet S2 among the plurality of sheets S forming the sheet bundle 5 and an imaginary straight line K2 extending along one surface of the first sheet S1 (see FIG. 29). The binding control section 26 sets the shift angle A1 to an acute angle. For example, the shift angle A1 is set to 15° or more and 60° or less.

An operation example of the sheet binding apparatus 303 according to the third embodiment is explained. FIGS. 23 to 28 are front views illustrating the operation example of the sheet binding apparatus 303. In the third embodiment, explanation is omitted concerning the same operations as the operations in the first embodiment.

Figure 23:
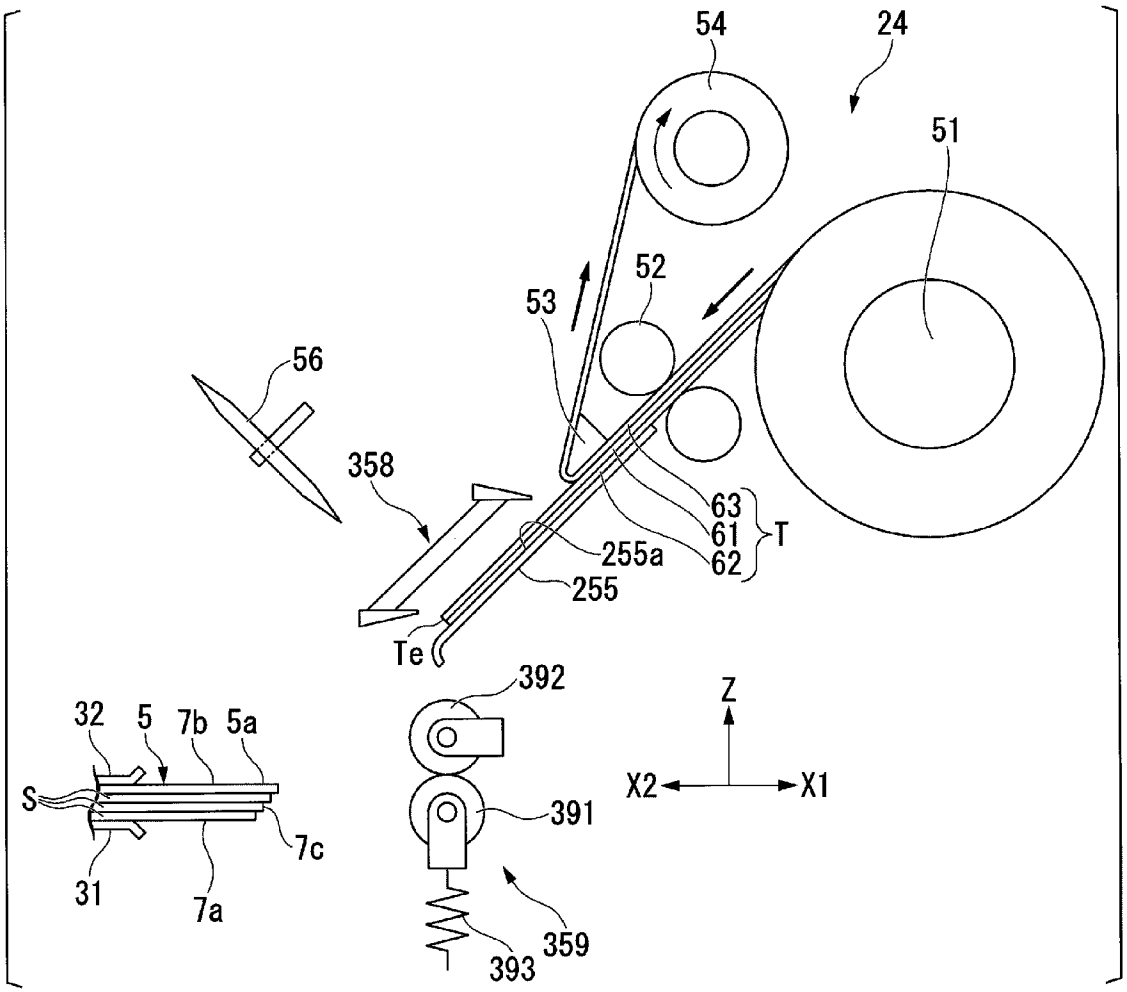
FIG. 23 is a front view illustrating the operation of the sheet binding apparatus.

As illustrated in FIG. 23, in this embodiment, the tape T conveyed along the guide stand 255 is held substantially flat by the flat surface 255*a* of the guide stand 255. The tape T conveyed along the guide stand 255 linearly extends along the flat surface 255*a* of the guide stand 255 with the own weight of the tape T.

Figure 24:
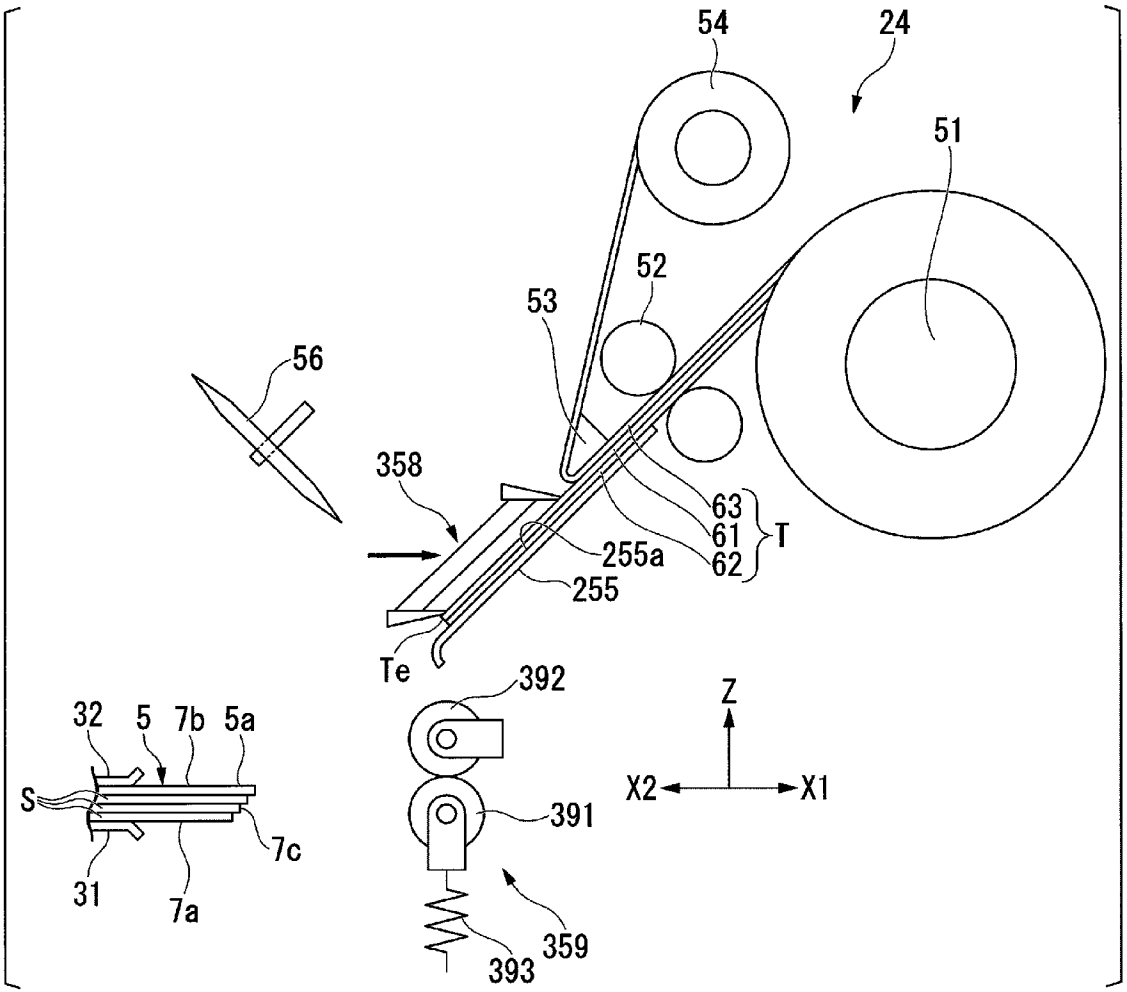
FIG. 24 is a front view illustrating the operation of the sheet binding apparatus following FIG. 23.

Subsequently, as illustrated in FIG. 24, the sheet binding apparatus 303 brings the tape holding section 358 into contact with the tape T to support the tape T in a state in which the posture of the tape T is retained. In this embodiment, the sheet binding apparatus 303 brings the tape holding section 358 into contact with the flat surface 255*a* of the guide stand 255 to retain the posture of the tape T substantially flat. In this embodiment, the tape holding section 358 holds, in the two parts at the upstream end and the downstream end in the conveying direction of the tape T, the linear tape T held by the flat surface 255*a*.

Figure 25:
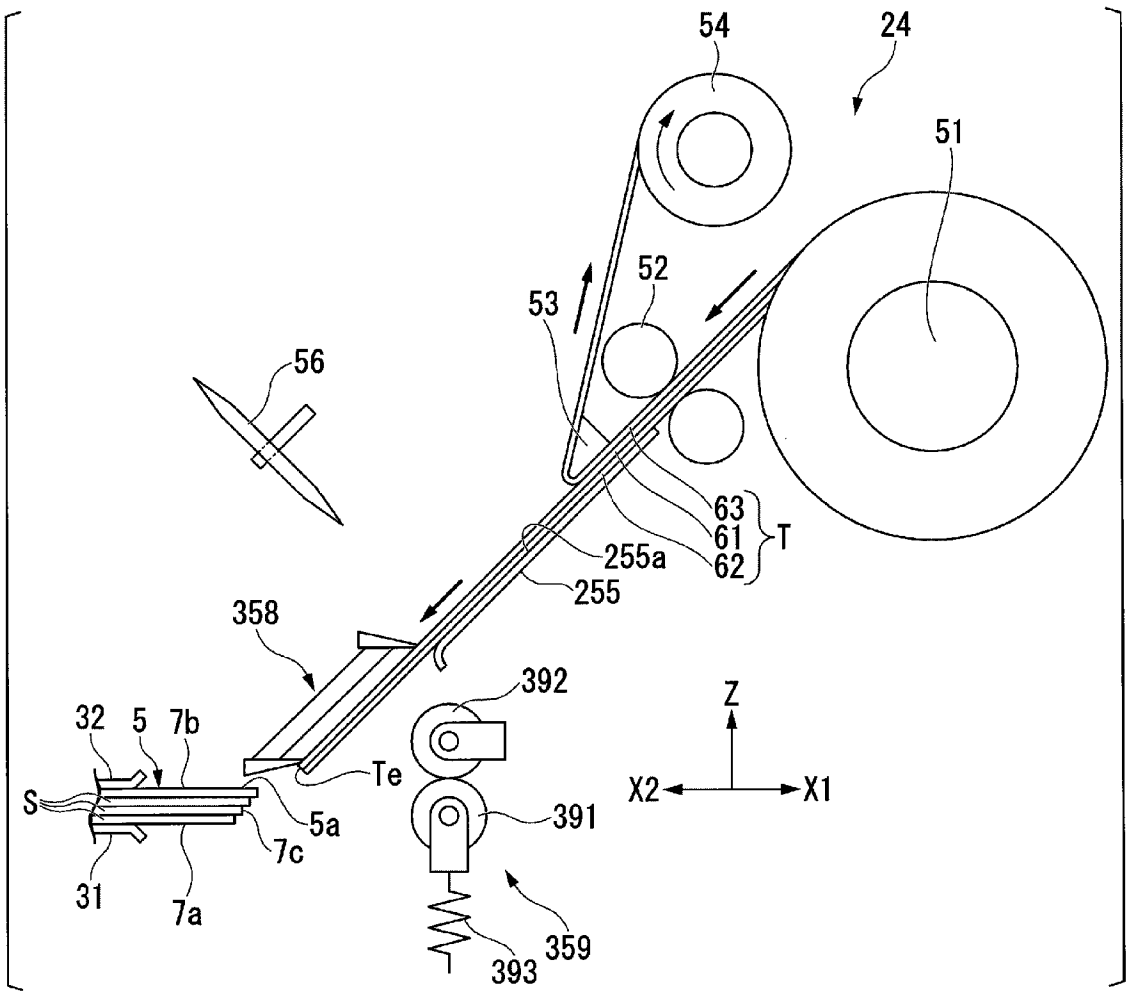
FIG. 25 is a front view illustrating the operation of the sheet binding apparatus following FIG. 24.

Subsequently, as illustrated in FIG. 25, the sheet binding apparatus 303 moves the tape holding section 358 to the conveying direction downstream side of the tape T by a cut length of the tape T.

Figure 26:
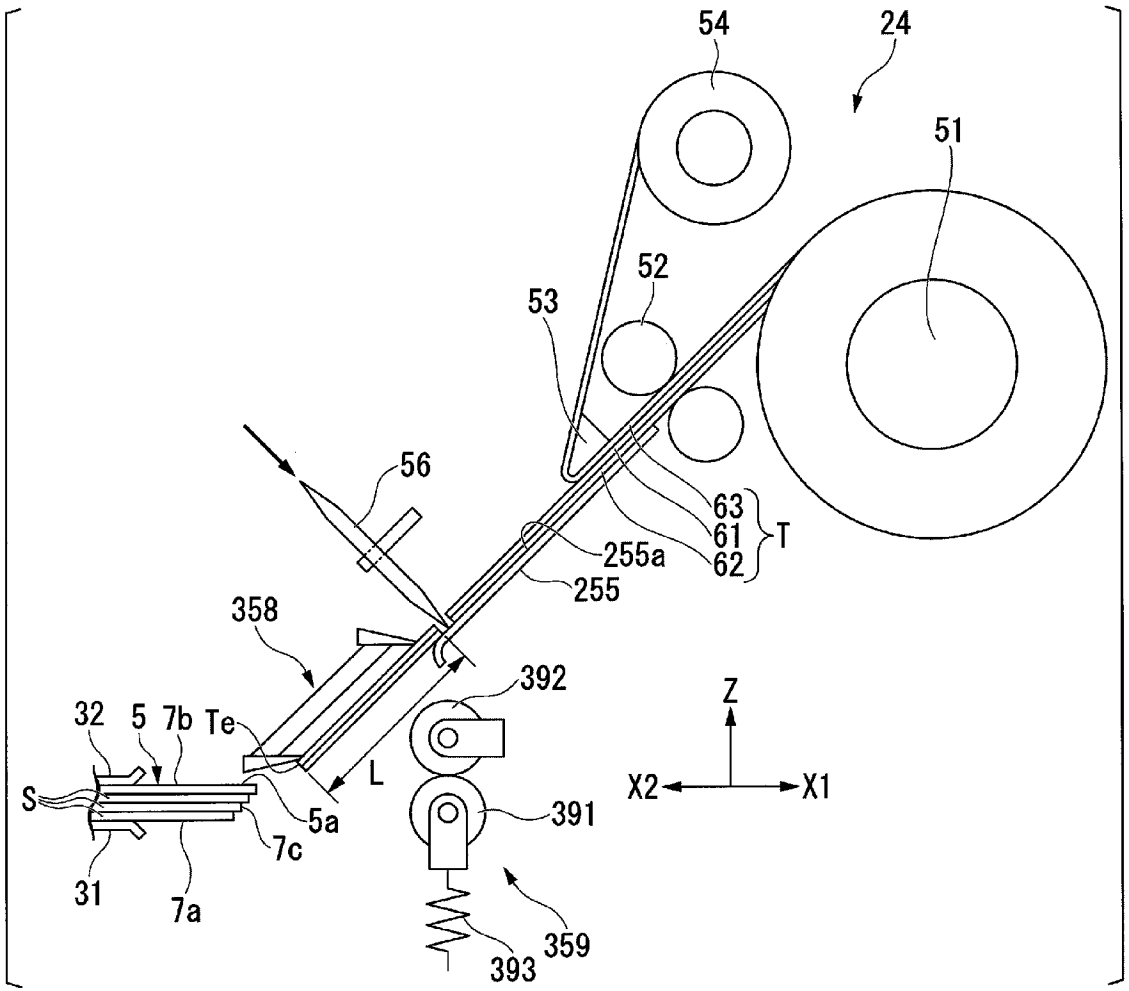
FIG. 26 is a front view illustrating the operation of the sheet binding apparatus following FIG. 25.

Subsequently, as illustrated in FIG. 26, the sheet binding apparatus 303 cuts the belt-like tape T with the cutter 56 to form the sheet-like tape T. Consequently, the tape T is cut into a necessary length.

Figure 27:
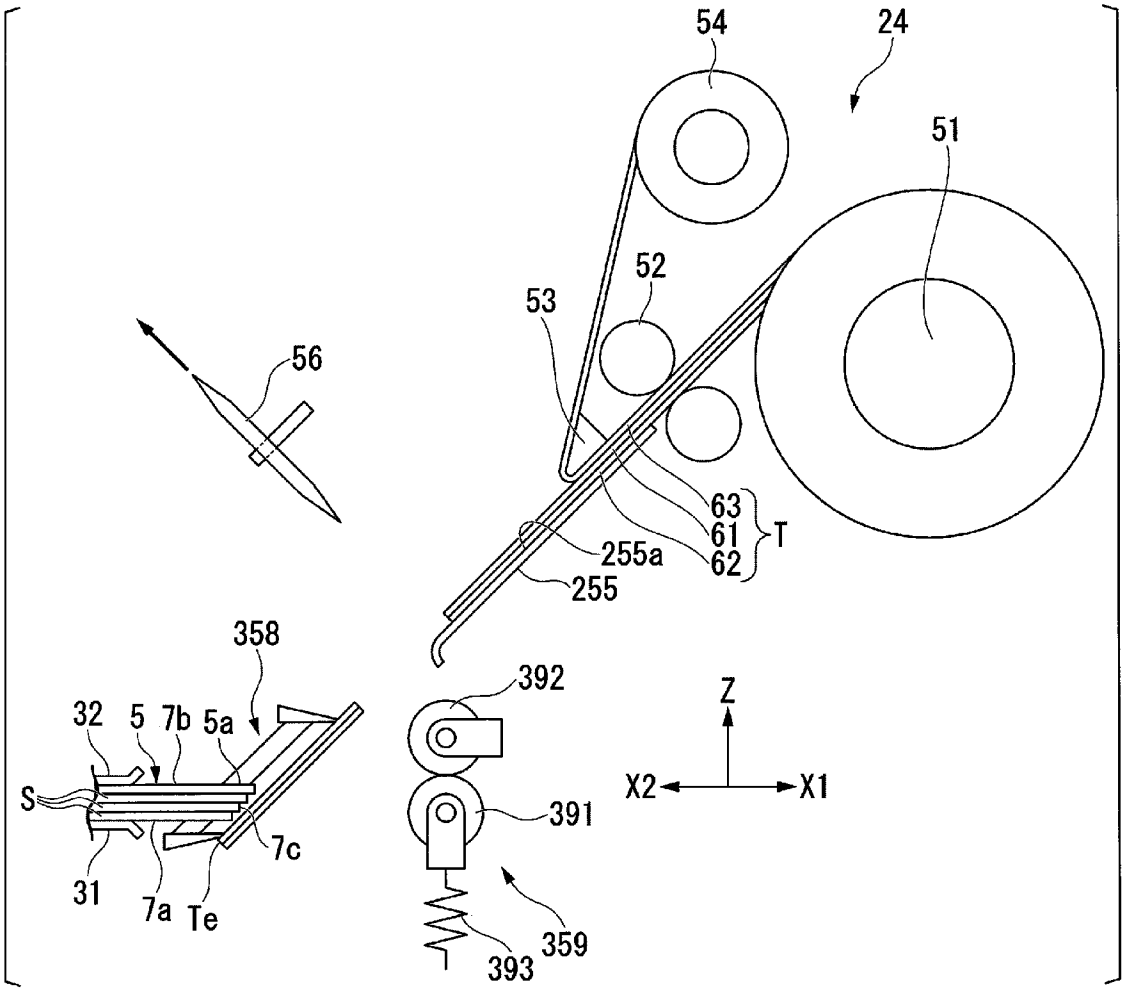
FIG. 27 is a front view illustrating the operation of the sheet binding apparatus following FIG. 26.

Subsequently, as illustrated in FIG. 27, the sheet binding apparatus 303 moves the tape holding section 358 to between the sheet bundle 5 and the tape attaching section 359. For example, the tape holding section 358 disposes the tape T to extend across the first roller 391 and the second roller 392. For example, the tape holding section 358 disposes the tape T such that the center of the substantially flat tape T faces a nip between the first roller 391 and the second roller 392.

The sheet binding apparatus 303 holds the tape T with the tape holding section 358 such that the adhesive surface of the tape T is inclined with respect to the inserting direction of the sheet bundle 5. In this embodiment, the tape holding section 358 holds the linear tape T and enables the sheet bundle 5 to be inserted while tilting the sheet bundle 5 by a shift angle of the edge portion 5*a* of the sheet bundle 5 with respect to the adhesive surface of the tape T.

Figure 28:
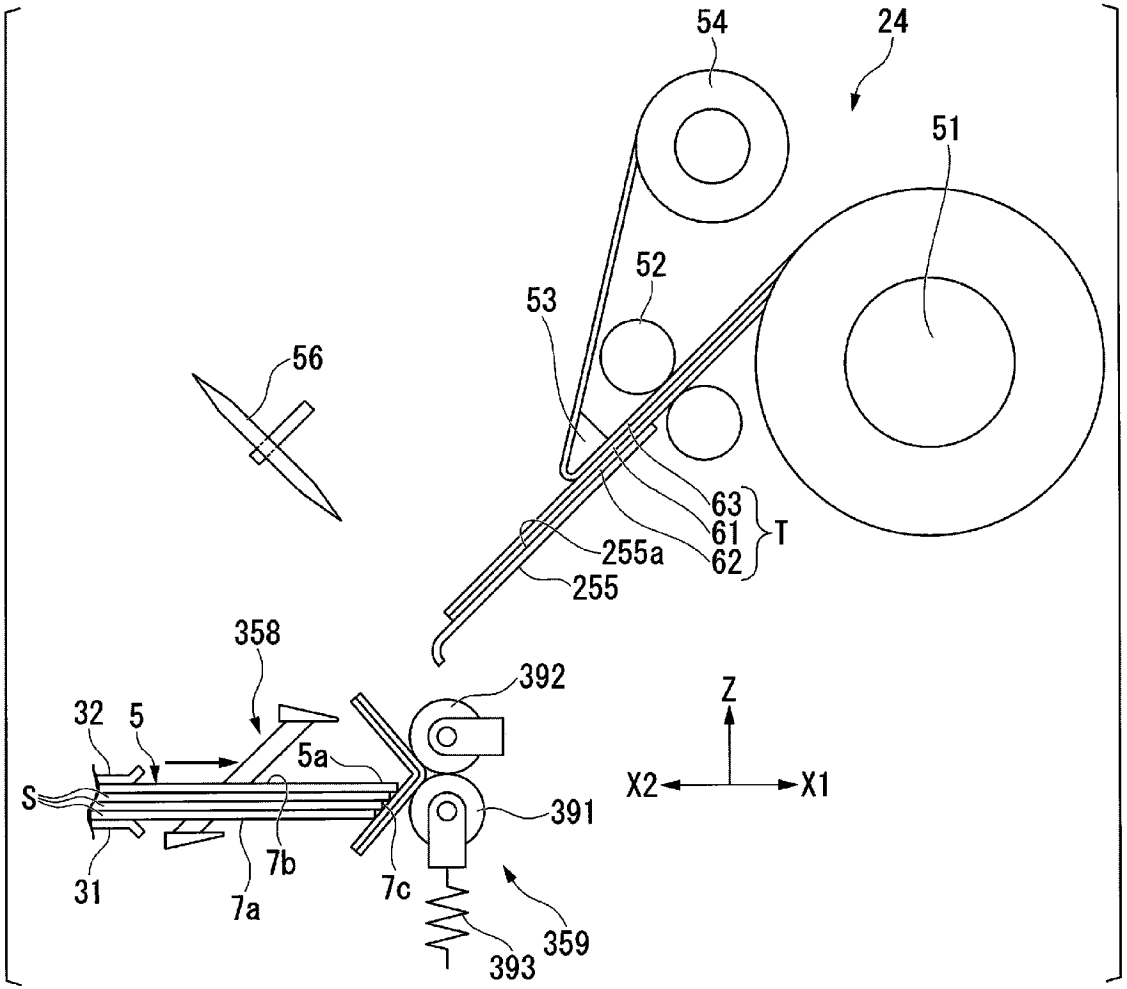
FIG. 28 is a front view illustrating the operation of the sheet binding apparatus following FIG. 27.
Figure 29:
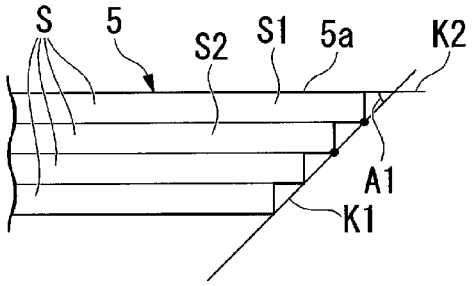
FIG. 29 is an explanatory diagram of a shift angle of an edge portion of a sheet bundle.

Subsequently, as illustrated in FIG. 28, the sheet binding apparatus 303 moves the sheet bundle 5 toward the tape attaching section 359 with the sheet shifting section 323. For example, the sheet binding apparatus 303 normally rotates the first roller 41 and the second roller 42 to move (insert) the sheet bundle 5 toward the tape attaching section 359.

The main guide 31 guides the sheet bundle 5 to between the two parts of the tape T held by the tape holding section 358. The tape holding section 358 linearly holds the tape T to incline with respect to the conveying direction of the sheet bundle 5 (the inserting direction of the sheet bundle 5). The sheet bundle 5 is guided by the main guide 31 and the sub-guide 32 such that the step-shaped end face 7*c* faces the inclined surface of the tape T.

The sheet binding apparatus 303 inclines the adhesive surface of the tape T with respect to the inserting direction of the sheet bundle 5 such that the step-shaped end face 7*c* of the sheet bundle 5 faces the inclined surface of the linear tape T. The sheet binding apparatus 303 brings the plurality of sheets S forming the sheet bundle 5 into contact with the tape T. The sheet binding apparatus 303 inserts the sheet bundle 5 into the tape T held by the tape holding section 358 to thereby peel the tape T from the tape holding section 358. The sheet binding apparatus 303 inserts the edge portion 5*a* of the sheet bundle 5 between the first roller 391 and the second roller 392 together with the tape T.

According to the third embodiment, the binding control section 26 holds the linear tape T with the tape holding section 358 and enables the sheet bundle 5 to be inserted while tilting the sheet bundle 5 by a shift angle of the edge portion 5*a* of the sheet bundle 5 with respect to the adhesive surface of the tape T. With the configuration explained above, the following effect is obtained. It is possible to suppress turn-up of the sheet S with a simple configuration that makes use of the holding of the linear tape T and the tilting at the shift angle.

A modification of the third embodiment is explained.

The sheet binding apparatus 303 is not limited to including the bundle forming section and the sheet shifting section. For example, the sheet binding apparatus may not include the bundle forming section and the sheet shifting section. For example, in the sheet binding apparatus, the insertion of the sheet bundle may be manually performed by a user.

Figure 30:
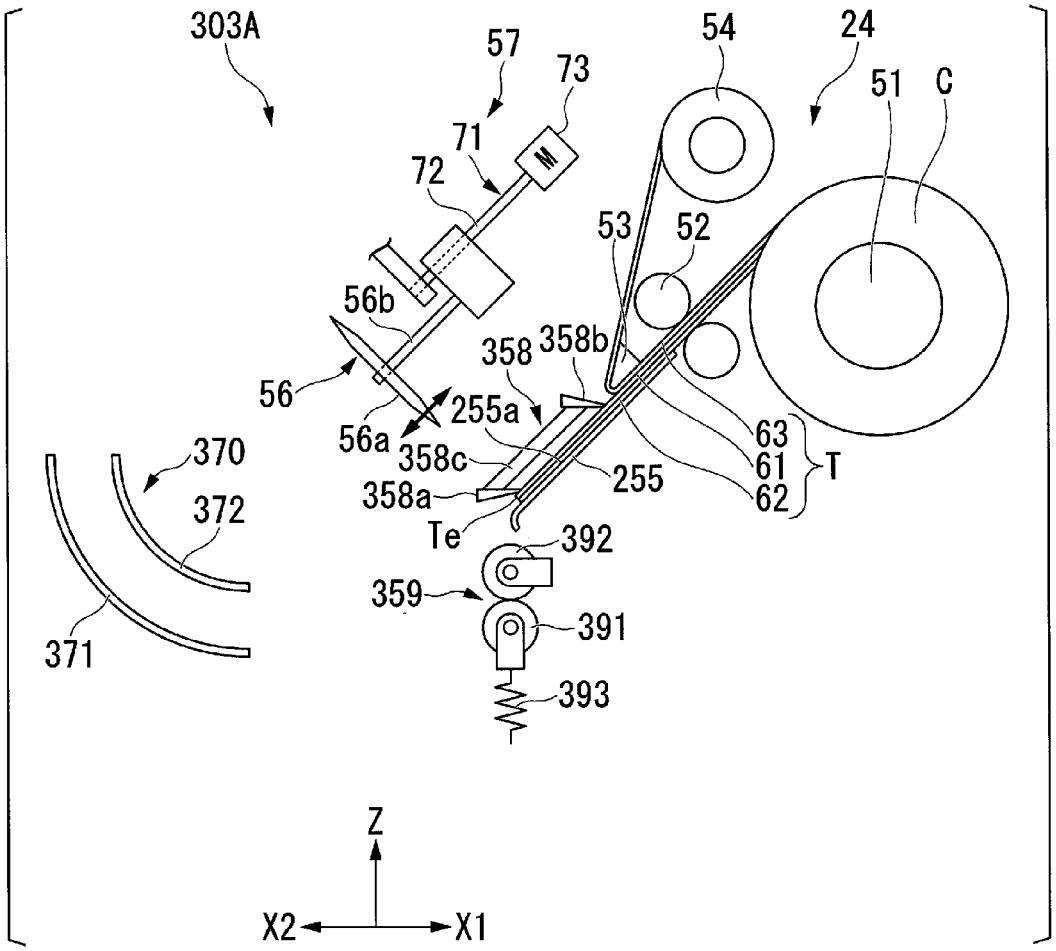
FIG. 30 is a front view illustrating a sheet binding apparatus in a modification of the third embodiment.
Figure 31:
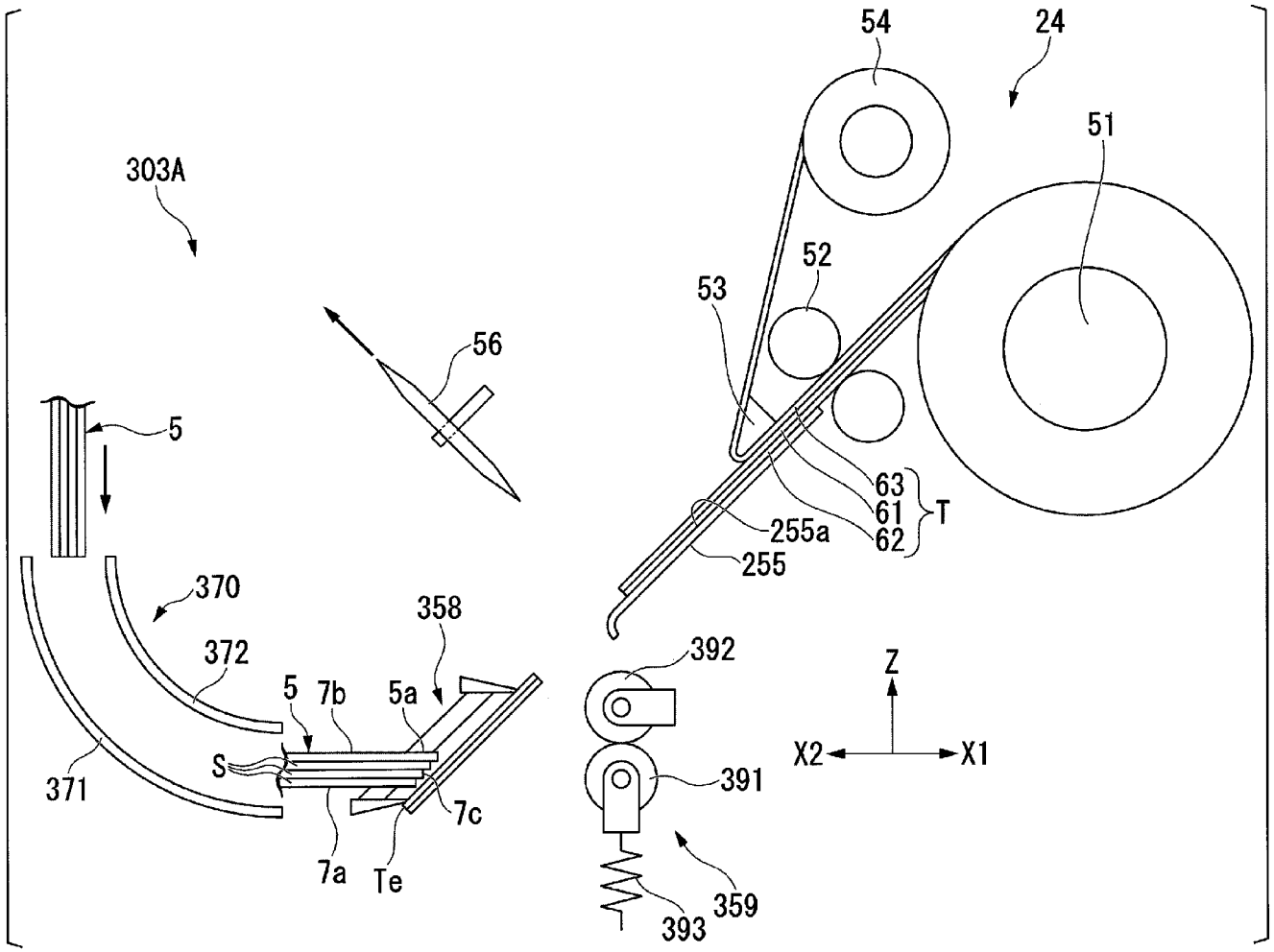
FIG. 31 is a front view illustrating the operation of the sheet binding apparatus.

FIG. 30 is a front view illustrating a sheet binding apparatus 303A in the modification of the third embodiment. FIG. 31 is a front view illustrating the operation of the sheet binding apparatus 303A in the modification of the third embodiment.

As illustrated in FIG. 30, the sheet binding apparatus 303A may further include a shift-angle setting section 370 that sets the shift angle of the edge portion 5*a* of the sheet bundle 5 to a target angle. The shift-angle setting section 370 has a curve shape, a lower side of which is closer to the tape attaching section 359. The shift-angle setting section 370 includes a main guide 371 and a sub-guide 372 opposed to each other. Each of the main guide 371 and the sub-guide 372 has an arcuate shape. The main guide 371 forms a conveying path of the sheet bundle 5. A space through which the sheet bundle 5 can pass is provided between the main guide 371 and the sub-guide 372.

As illustrated in FIG. 31, in this modification, the sheet binding apparatus 303A sets, with the shift-angle setting section 370, the shift angle of the edge portion 5*a* of the sheet bundle 5 to the target angle. For example, if the sheet bundle 5 is inserted into the shift-angle setting section 370 from above, the edge portion 5*a* of the sheet bundle 5 comes into contact with a curved surface of the main guide 371 formed in a curve shape, a lower side of which is closer to the tape attaching section 359. Then, the end face 7*c* of the sheet bundle 5 is formed in a step shape in a specific direction facing the adhesive surface of the tape T. Therefore, if the sheet bundle 5 passes the shift-angle setting section 370, the shift angle of the edge portion 5*a* of the sheet bundle 5 is set to the target angle.

According to this modification, it is possible to more effectively suppress turn-up of the sheet S compared with when the shift angle of the edge portion 5*a* of the sheet bundle 5 is set at random.

The sheet binding apparatus is not limited to being the post-processing apparatus that is disposed beside the image forming apparatus 2 and performs the post-processing on the sheet S conveyed from the image forming apparatus 2. For example, the sheet binding apparatus is not limited to the example explained above and may be an apparatus placed on, for example, a table or a floor surface and independently used.

The binding control section 26 is not limited to performing the control of, for example, the holding of the tape. For example, instead of the binding control section 26 (the control section on the sheet binding apparatus side), the control section 16 (the control section on the image forming apparatus side) may perform the control of, for example, the holding of the tape. That is, at least one of the binding control section 26 and the control section 16 may perform the control of, for example, the holding of the tape. An external control section (not illustrated in the figures) of the image forming system (the image forming apparatus and the post-processing apparatus) may perform the control of, for example, the holding of the tape.

According to at least one embodiment explained above, the sheet binding apparatus includes the tape holding section that holds the tape in at least the two parts. The tape holding section bends and holds the tape to be convex to the conveying direction downstream side of the sheet bundle. Consequently, it is possible to provide the sheet binding apparatus that can suppress turn-up of the sheet.

The functions of the image forming system (the image forming apparatus and the post-processing apparatus) in the embodiments explained above may be realized by a computer. In that case, the functions may be realized by recording a computer program for realizing the functions in a computer-readable recording medium, causing a computer system to read the computer program recorded in the recording medium and executing the computer program. The "computer system" includes an OS and hardware such as peripheral devices. The "computer-readable recording medium" refers to a portable medium such as a flexible disk, a magneto-optical disk, a ROM, or a CD-ROM or a storage device such as a hard disk incorporated in the computer system. Further, the "computer-readable recording medium" may include a medium that dynamically retains the computer program for a short time such as a communication line in transmitting the computer program via a network such as the Internet or a communication line such as a telephone line or may include a medium that retains the computer program for a fixed time such as a volatile memory inside a computer system functioning as a server or a client in that case. The computer program may be a computer program for realizing a part of the functions or may be a computer program that can realize the functions in combination with a computer program already recorded in the computer system.

The several embodiments are explained above. However, the embodiments are presented as examples and are not intended to limit the scope of the invention. These new embodiments can be implemented in other various forms. Various omissions, substitutions, and changes can be made without departing from the spirit of the invention. These embodiments and modifications of the embodiments are included in the scope and the gist of the invention and included in the inventions described in claims and the scope of equivalents of the inventions.

What is claimed is:

1. A sheet binding apparatus, comprising:

a tape holding section configured to hold a tape in at least two different locations of the tape;

a guide section configured to guide a sheet bundle to between the two different locations of the tape, and a tape conveyance guide configured to form a conveying path of the tape, wherein the tape holding section bends and holds the tape so as to be convex with respect to a conveying direction on a downstream side of the sheet bundle, and wherein the tape conveyance guide includes a recessed section for holding the tape to be bent in a curve shape.

2. The apparatus according to claim 1, further comprising:

a tape conveying section configured to convey the tape; and a binding control section configured to, in a state in which the tape holding section holding the tape in a position avoiding the recessed section of the tape conveyance guide is stopped, control conveyance of the tape with the tape conveying section and bend the tape in a curved state in the recessed section.

3. The apparatus according to claim 2, further comprising:

a tape cutter that cuts the tape, wherein the binding control section is further configured to change, based on a shift amount between sheets of the sheet bundle, a length of the tape cut by the tape cutter.

4. The apparatus according to claim 1, wherein a conveying direction of the tape crosses a vertical plane, and the recessed section of the tape conveyance guide has a curve shape convex downward.

5. The apparatus according to claim 1, further comprising:

a bundle forming section that forms the sheet bundle.

6. The apparatus according to claim 5, wherein the bundle forming section comprises a sheet shifting section that shifts a plurality of sheets of the sheet bundle little by little in the sheet bundle conveying direction to form a state in which the plurality of sheets forming the sheet bundle are shifted from one another in a step shape at an edge portion of the sheet bundle.

7. A post-processing apparatus comprising the sheet binding apparatus according to claim 1.

8. An image forming apparatus, comprising:

an image forming section that forms an image on sheets and stacks the sheets into a sheet bundle; and a sheet binding apparatus, comprising:

a tape holding section configured to hold a tape in at least two different locations of the tape;

a guide section configured to guide the sheet bundle to between the two different locations of the tape, and a tape conveyance guide configured to form a conveying path of the tape wherein the tape holding section bends and holds the tape so as to be convex with respect to a conveying direction on a downstream side of the sheet bundle, and wherein the tape conveyance guide includes a recessed section for holding the tape to be bent in a curve shape.

9. The apparatus according to claim 8, wherein the sheet binding apparatus further comprises:

a tape conveying section configured to convey the tape; and a binding control section configured to, in a state in which the tape holding section holding the tape in a position avoiding the recessed section of the tape conveyance guide is stopped, control conveyance of the tape with the tape conveying section and bend the tape in a curved state in the recessed section.

10. The apparatus according to claim 8, wherein the sheet binding apparatus further comprises:

a tape cutter that cuts the tape, wherein the binding control section is further configured to change, based on a shift amount between sheets of the sheet bundle, a length of the tape cut by the tape cutter.

11. The apparatus according to claim 8, wherein a conveying direction of the tape crosses a vertical plane, and the recessed section of the tape conveyance guide has a curve shape convex downward.

12. The apparatus according to claim 8, wherein the sheet binding apparatus further comprises:

a bundle forming section that forms the sheet bundle.

13. The apparatus according to claim 12, wherein the bundle forming section comprises a sheet shifting section that shifts a plurality of sheets of the sheet bundle little by little in the sheet bundle conveying direction to form a state in which the plurality of sheets forming the sheet bundle are shifted from one another in a step shape at an edge portion of the sheet bundle.

* * * * *